US008444393B2

(12) United States Patent
Beck et al.

(10) Patent No.: US 8,444,393 B2
(45) Date of Patent: May 21, 2013

(54) ROD PUMP CONTROL SYSTEM INCLUDING PARAMETER ESTIMATOR

(75) Inventors: Thomas L. Beck, Union Grove, WI (US); Ronald G. Peterson, Racine, WI (US); Mark E. Garlow, Kenosha, WI (US); Theresa Smigura, Winthrop Harbor, IL (US)

(73) Assignee: Unico, Inc., Franksville, WI (US)

( * ) Notice: Subject to any disclaimer, the term of this patent is extended or adjusted under 35 U.S.C. 154(b) by 811 days.

(21) Appl. No.: 11/480,085

(22) Filed: Jun. 30, 2006

(65) Prior Publication Data

US 2006/0251525 A1 Nov. 9, 2006

Related U.S. Application Data

(62) Division of application No. 10/655,777, filed on Sep. 5, 2003, now Pat. No. 7,168,924.

(60) Provisional application No. 60/414,197, filed on Sep. 27, 2002, provisional application No. 60/429,158, filed on Nov. 26, 2002.

(51) Int. Cl.
*F04B 43/12* (2006.01)

(52) U.S. Cl.
USPC ..... 417/53

(58) Field of Classification Search
USPC ..... 417/44.1, 44.11, 555.1, 555.2, 556, 417/53; 702/145
See application file for complete search history.

(56) References Cited

U.S. PATENT DOCUMENTS 2,691,300 A * 10/1954 Morris ..... 73/862.191
3,343,409 A * 9/1967 Gibbs ..... 73/152.61
3,585,484 A 6/1971 Dortort
3,765,234 A * 10/1973 Sievert ..... 73/862.191
3,851,995 A 12/1974 Mills
3,854,846 A 12/1974 Douglas
3,915,225 A 10/1975 Swink
3,918,843 A 11/1975 Douglas et al.
3,930,752 A 1/1976 Douglas
3,936,231 A 2/1976 Douglas
3,938,910 A 2/1976 Douglas
3,951,209 A 4/1976 Gibbs
3,963,374 A 6/1976 Sullivan (Continued)

OTHER PUBLICATIONS

Kuhne, Steven and Riefenstahl, Ulrich. "A New Torque Calculator for AC Induction Motor Drives that Improves Accuracy and Dynamic Behavior." Apr. 1999. IEEE.*

(Continued)

*Primary Examiner* — Devon Kramer
*Assistant Examiner* — Amene Bayou
(74) *Attorney, Agent, or Firm* — Reinhart Boerner Van Deuren s.c.

(57) ABSTRACT

A rod pump control system includes a parameter estimator that determines from motor data parameters relating to operation of the rod pump and/or downhole dynamometer card without the need for external instrumentation, such as down hole sensors, echo meters, flow sensors, etc. In one embodiment, instantaneous motor current and voltage together with pump parameters are used in determining rod position and load. The rod position and load are used to control the operation of the rod pump to optimize the operation of the pump. Also disclosed in a pump stroke amplifier that is capable of increasing pump stroke without changing the overall pumping speed, or in the alternative, maintaining the well output with decreased overall pumping speed.

10 Claims, 23 Drawing Sheets

U.S. PATENT DOCUMENTS 3,965,983 A 6/1976 Watson
3,998,568 A 12/1976 Hynd
4,058,757 A 11/1977 Welton et al.
4,102,394 A 7/1978 Botts
4,108,574 A 8/1978 Bartley et al.
4,118,148 A 10/1978 Allen
4,145,161 A 3/1979 Skinner
4,171,185 A 10/1979 Duke et al.
4,194,393 A 3/1980 Boley
4,220,440 A 9/1980 Taylor et al.
4,286,925 A 9/1981 Standish
4,363,605 A 12/1982 Mills
4,370,098 A * 1/1983 McClain et al. ..... 417/18
4,390,321 A 6/1983 Langlois et al.
4,406,122 A 9/1983 McDuffie
4,438,628 A 3/1984 Creamer
4,474,002 A 10/1984 Perry
4,476,418 A 10/1984 Werner
4,480,960 A 11/1984 Streib
4,483,188 A 11/1984 McTamaney et al.
4,487,061 A 12/1984 McTamaney et al.
4,490,094 A * 12/1984 Gibbs ..... 417/42
4,507,055 A 3/1985 Fair et al.
4,508,487 A 4/1985 Taylor et al.
4,508,488 A 4/1985 Pikna
4,509,901 A 4/1985 McTamaney et al.
4,534,168 A 8/1985 Brantly
4,534,706 A 8/1985 Palm et al.
4,541,274 A 9/1985 Purcupile
4,583,915 A 4/1986 Montgomery et al.
4,594,665 A 6/1986 Chandra et al.
4,631,954 A 12/1986 Mills
4,661,751 A 4/1987 Werner
4,681,167 A 7/1987 Soderberg
4,695,779 A 9/1987 Yates
4,741,397 A 5/1988 Weeks
4,747,451 A 5/1988 Adams, Jr. et al.
4,830,112 A 5/1989 Erickson
4,859,151 A 8/1989 Reed
4,873,635 A 10/1989 Mills
4,935,685 A 6/1990 Justus et al.
4,971,522 A 11/1990 Butlin
4,973,226 A 11/1990 McKee
5,006,044 A 4/1991 Walker, Sr. et al.
5,044,888 A 9/1991 Hester, II
5,064,349 A 11/1991 Turner et al.
5,129,264 A 7/1992 Lorenc
5,129,267 A 7/1992 Nicholls
5,167,490 A 12/1992 McKee et al.
5,180,289 A 1/1993 Wenholz et al.
5,204,595 A 4/1993 Opal et al.
5,205,163 A * 4/1993 Sananikone ..... 73/152.48
5,222,867 A 6/1993 Walker, Sr. et al.
5,224,834 A 7/1993 Westerman et al.
5,230,607 A 7/1993 Mann
5,237,863 A 8/1993 Dunham
5,240,380 A 8/1993 Mabe
5,246,076 A 9/1993 Watson
5,251,696 A 10/1993 Boone et al.
5,252,031 A * 10/1993 Gibbs ..... 417/53
5,281,100 A 1/1994 Diederich
5,284,422 A 2/1994 Turner et al.
5,316,085 A 5/1994 Dawson
5,318,409 A 6/1994 London et al.
5,362,206 A * 11/1994 Westerman et al. ..... 417/12
5,372,482 A 12/1994 London et al.
5,425,623 A 6/1995 London et al.
5,441,389 A 8/1995 Wolcott et al.
5,444,609 A 8/1995 Swamy et al.
5,458,466 A 10/1995 Mills
5,634,522 A 6/1997 Hershberger
5,819,849 A 10/1998 Booth
5,820,350 A * 10/1998 Mantey et al. ..... 417/45
5,823,262 A 10/1998 Dutton
5,829,530 A 11/1998 Nolen
5,868,029 A 2/1999 Paine
5,941,305 A 8/1999 Thrasher et al.
5,996,691 A 12/1999 Norris et al.
6,041,856 A 3/2000 Thrasher et al.
6,043,569 A 3/2000 Ferguson
6,079,491 A 6/2000 Stuebinger et al.
6,092,600 A 7/2000 McKinzie et al.
6,127,743 A 10/2000 Levin et al.
6,129,110 A 10/2000 Kolb
6,155,347 A 12/2000 Mills
6,176,682 B1 1/2001 Mills
6,343,656 B1 * 2/2002 Vazquez et al. ..... 166/373
6,449,567 B1 * 9/2002 Desai et al. ..... 702/58
6,464,464 B2 10/2002 Sabini et al.
6,585,041 B2 7/2003 Crossley
6,592,340 B1 7/2003 Horo et al.
2003/0180151 A1 9/2003 Jeun
2003/0235492 A1 12/2003 Mirsky et al.

OTHER PUBLICATIONS

Gibbs, S.C.: "Predicting the Behavior of Sucker-Rod Pumping Systems", JPT (Jul. 1963, 769-78, Trans, AIME 228).
Garlow, M.E.: Sensorless Estimation of a Sucker-Rod Pump Downhold Dynacard, Unico, Inc., Aug. 12, 2002.
Everitt, T.A, and Jennings, J.W.: An Improved Finite-Difference Calculation of Downhold Dynamometer Cards for Sucker-Rod Pumps , Paper SPE 18189, SPE Production Engineering (Feb. 1992).
Jansen, P.L. and Lorenz, R.D.: Accurary Limitations of Velocity and Flux Estimation in Direct Field Oriented Induction Machines, Power Electronics and Applications, 1993, Fifth European Conference on , 1993; 312-318, vol. 4.
Lorenz, R.D. and Lawson, D.B.: A Simplified Approach to Continuous On-Line Tuning of Field-Oriented Induction Machine Drives, IEEE Transactions on Industry Applications, vol. 26, No. 3, May/Jun. 1990.
Hasan, A.R. and Kabir, C.S.: Fluid Flow and Heat Transfer in Wellbores, Society of Petroleum Engineers, Richardson, TX, 2002.

* cited by examiner

SURFACE DYNAMOMETER GRAPH, 7 SPM

SURFACE DYNAMOMETER GRAPH, 7 SPM CONTROL ENABLED

PUMP DYNAMOMETER GRAPH, 7 SPM

PUMP DYNAMOMETER GRAPH, 7 SPM CONTROL ENABLED

PUMP VELOCITY, 7 SPM

PUMP VELOCITY, 7 SPM CONTROL ENABLED

ROD PUMP CONTROL SYSTEM INCLUDING PARAMETER ESTIMATOR

CROSS REFERENCE TO RELATED APPLICATION

This application is a divisional application of application Ser. No. 10/655,777, filed on Sep. 5, 2003, now U.S. Pat. No. 7,168,925, which application claims priority benefit from provisional application No. 60/414,197, filed on Sep. 27, 2002, and provisional application No. 60/429,158, filed on Nov. 26, 2002, all three of which applications are incorporated herein by reference in their entirety.

BACKGROUND OF THE INVENTION

Field of the Invention

The present invention relates generally to control of rod pumps for oil and gas wells, and in particular to methods for optimizing the operation of rod pumps using parameter estimation.

The load upon and position of the rods that drive downhole pumps are important parameters for control, monitoring, and protection of the artificial lift system used in oil and gas production. Existing methods of measuring these parameters involve the mounting and use of external instruments such as strain gauges, load cells, and position transducers. The need for these additional devices increases the cost and complexity of the pumping system and reduces system reliability. Generally, AC induction motors drive rod pumping systems.

One method for determining rod load or force is disclosed in U.S. Pat. No. 4,490,094 (the '094 patent). With this method, motor velocity is determined during a complete or predetermined portion of a reciprocation cycle and the results are used to compute one or more parameters of pumping unit performance.

However, determination of rod load $PRL_i$ on an ith revolution of the prime mover rotor depends on knowing the position of crank for computation of a torque factor TFi according to the equation (1):

$$PRLi = \frac{n \cdot Ti + m \cdot \sin(\varphi_i + \beta) - RIT + AIT}{TFi} \quad (1)$$

Because the torque factor TFi appears in the denominator of the equation, special care must be taken in deriving the torque factor $Tf_i$ and in using it in the computation to avoid dividing by zero or by small numbers that would distort the result. Moreover, the '094 patent does not disclose how to estimate crank position.

U.S. Pat. No. 5,252,031 (the '031 patent) discloses a method for monitoring a rod pumped well to detect various problems. The method uses measurements made at the surface to calculate a downhole pump dynamometer card. This downhole pump dynamometer card is useful in detecting various pump problems and controlling the pumping unit. The method involves finding rod position from motor revolutions, a reference switch and pump geometry. This method requires setting up look-up tables.

In addition, the methods disclosed in both the '031 patent and the '094 patent employ a sensor to detect a rotation of the motor shaft. Because of the ratio between motor and pump rotations, this method can produce numerous sample points per stroke of the pump. However, the time between motor revolutions to get motor velocity as well as sample other parameters, such as motor current, is a function of pump speed and is not suitable for precise monitoring of the pump operation. In addition, the method of determining motor torque relies on a look-up table of steady-state motor operation rather than a true dynamic calculation of torque. These methods would work fine for providing simple pump control function, such as shutting down the pump when it is pumped off. However, these methods would not be suitable for real time closed-loop pump control, such as rod load limiting, that requires a high bandwidth feedback signal.

Past work involving the analysis of rod pump systems can be divided into two categories. One such category involves predicting the performance of a rod pump unit by calculating surface load from known surface position and assumed pump load. An example of this method for deriving the surface dynamometer card from the downhole dynamometer card is disclosed in an article entitled "Predicting the Behavior of Sucker-Rod Pumping Systems", by S. G. Gibbs, in JPT, July 1963, pages 769-78, Trans, AIME 228. This uses a multisection model of the rod string to simulate the pump operation.

The other category deals with the diagnosis of existing pumping installations by determining actual pump conditions from measured surface conditions. U.S. Pat. No. 3,343,409 discloses a method for estimating the downhole dynamometer card from the surface dynamometer card using frequency based Fourier analysis. However, this method requires a large number of coefficients to accurately model the high frequency components that produce the corners of the dynamometer card. In addition, the method relies on external sensors for polished rod load and position.

The average output flow rate of a sucker rod pump is a function of the downhole pump stroke and the average speed of the pump. With existing technologies, the downhole stroke of the pump is dictated by the speed of the pumping unit and the given characteristics of the pumping unit geometry and the sucker rod stiffness. Significant stretch in the sucker rod, particularly for deep wells, reduces the amount of surface rod stroke that can be delivered to the downhole pump. Additionally, the speed of the pumping operation is often limited by the need to avoid overstressing the sucker rod and/or the pumping unit gearbox. Therefore, output flow rate is constrained by the imposed pump stroke and stroking rate.

SUMMARY OF THE INVENTION

The disadvantages and limitations of the background art discussed above are overcome by the present invention. With this invention, there is provided a method of continuously determining operational parameters of a rod pump used in oil and gas production, wherein the rod pump includes a rod string carrying a downhole pump, the rod string including a polished rod, and a drive system including an AC electrical drive motor having a rotor coupled to the rod string through a transmission unit. The method comprises the steps of continuously measuring the electrical voltages applied to the drive motor to produce electrical voltage output signals; continuously measuring the electrical currents applied to the drive motor to produce electrical current output signals; deriving values of instantaneous electrical torque from the electrical voltage output signals and the electrical current output signals; deriving values of instantaneous motor velocity from the electrical voltage output signals and the electrical current output signals; and using geometry of the rod pumping unit and one of the instantaneous values to calculate instantaneous values of an operating parameter of the rod pump. In one embodiment, the method is used for calculating rod load and/or rod position of a rod pump. The method also provides calculations of other pump parameters such as gearbox torque and pump stroke that are useful in protecting the pumping mechanism and diagnosing pump problems.

The invention provides a method of deriving operating parameters, such as rod load and position, from the drive motor and pumping unit parameters without the need for external instrumentation such as down hole sensors, echo meters, flow sensors, etc. The method provides nearly instantaneous readings of motor velocity and torque which can be used for both monitoring and real-time, closed-loop control of the rod pump. In addition, American Petroleum Institute specification geometry and system identification routines are used to establish parameters used in calculating the performance parameters that are used in real time closed loop control of the operation of the rod pump, obviating the need to create large look-up tables for parameter values used in calculating performance parameters. Simple parameters defining the special geometry used in belt driven pumping units are also included in the control.

In one embodiment, wherein the first and second operating parameters are instantaneous position and load of the polished rod, the method includes the steps of using the estimated values of position and load for the polished rod to obtain a surface dynamometer card for the rod pump, and deriving from the surface dynamometer card the instantaneous position and load of the downhole pump for pump control and/or generation of a downhole dynamometer card for the pump.

The parameter estimator reduces the cost and complexity of rod pumping systems and provides rod load measurement accuracy superior to systems using sensors such as strain gages and load cells. Moreover, this eliminates wires to sensors mounted on moving portions of the pump and reliability issues related to the sensors and their associated wiring.

Further in accordance with the invention, the parameter estimator produces values of rod pump parameters which can be used in optimizing the operation of the rod pump. Thus, in accordance with a further aspect of the invention, there are provided several methods of controlling the rod load and/or flow rate of a rod pump used in oil and gas production and/or preventing damage to the pump assembly, wherein the rod pump includes a rod string including a polished rod and a drive system including an AC electrical motor having a rotor that is coupled through a transmission unit to the rod string for reciprocating a downhole pump.

One method for rod load control uses the computed rod load to control the force in the rod and thereby prevent damage to the rod string due to excessive tension or compression of the sucker rod. Increased pump speeds will typically produce large tensile force excursions on the up stroke and large compressive forces on the downstroke. The method limits those excursions to preset limits by manipulating the pumping speed. A second aspect of the method provides for intentionally increasing or decreasing rod load during certain portions of the pump cycle to increase pump stroke and associated fluid production.

Another method of rod pump control provides for the use of a model of the rod string to derive a factor for modulating pump speed that reduces rod peak loads, damps rod force excursions, reduces gearbox torque loading, increases pump stroke, and improves energy efficiency without the need for external rod load and position sensors. Several embodiments of this method use somewhat different models for control of the pump. Those models include the use of rod load and/or rod position to generate control signals that manipulate pump operation.

The rod pump control method comprises the steps of obtaining a measure of the velocity of the polished rod in real-time; obtaining a measure of polished rod load in real-time; obtaining an estimate of the velocity of the pump in real-time; deriving a modulating factor from the difference between the velocity of the polished rod and the estimated pump velocity; and using the modulating factor to modulate motor speed to cause the downhole pump to more closely follow the polished rod stroke without excessive excursions in rod load.

The invention allows the stroke of the downhole pump to be increased without an increase in overall average pumping speed. This increases well fluid production without increasing overall pumping speed and enables increased output in wells that are running at maximum physical capacity of the pumping system. Alternatively, the method can maintain well output with decreased overall pumping speed, reduced rod stress fluctuation, and improved energy efficiency.

In accordance with a further aspect of the invention, there is provided a system for continuously determining operating parameters of a rod pump used in oil or gas production, the rod pump including a rod string carrying a downhole driven by an electrical drive motor that is coupled to the rod string through a transmission unit. The system comprises means for determining the torque and velocity inputs to the rod pump, means for using the torque and velocity inputs to calculate one or more values representing the performance of the rod pump, and means for using parameters related to the geometry of the rod pump and at least one of said performance values to calculate values of at least one operating parameter of the rod pump.

The rod pump control reduces peak rod loads, prevents compressive rod forces, and dampens rod load oscillations thereby reducing rod fatigue and rod failure. In addition, the rod pump control reduces peak pump velocity, resulting in less power lost to viscous pump friction, increasing pumping efficiency and reducing pump wear. Moreover, internal frictional losses in the rod are reduced by damping rod oscillations, thereby increasing pumping efficiency.

DESCRIPTION OF THE DRAWINGS

These and other advantages of the present invention are best understood with reference to the drawings, in which.

DEFINITIONS OF TECHNICAL TERMS

The following are definitions of some of the technical terms used in the detailed description of the preferred embodiments.

Beam Weight (Wb): The equivalent weight of the beam that is used to calculate its articulating inertia.

Counterweight Angle (At): The angle of the crank counterweight offset.

Counterweight Inertia (Jc): The effective inertia of the counterweight.

Crank Angle (Ac) The angular position of the beam pump crankshaft at the output of the reduction gearbox with respect to a reference point.

Crank Velocity (Wc): The change in crank angle as a function of time. The time derivative of the crank angle.

Downhole Pump Velocity (Vp): The velocity of the downhole pump as determined by the rod string/pump simulation algorithm.

Electrical Torque (Te): The torque generated at the motor shaft as determined from the motor voltages and currents.

Excitation Frequency (We): The fundamental frequency of the instantaneous current circulating in the drive motor.

Gearbox Output Torque (Tn): The torque at the output of the gearbox.

Motor Inertia (Jm): The inertia of the motor and associated components rotating at the motor speed.

Motor Velocity (Wr): The feedback velocity of the motor as determined from the motor voltages and currents.

Overall Gear Ratio (Ng): The gearing reduction between the motor output shaft and the crank shaft of the pumping unit. The pumping unit gear ratio.

Rod Load (Fr): The load applied to the polished rod as determined by the motor torque, pumping unit geometry, and pumping system parameters.

Rod Position (Xr): The position of the polished rod as determined by the motor position and the pumping unit geometry.

Rod Velocity (Vr): The velocity of the polished rod as determined by the motor velocity and the pumping unit geometry.

Rotary Weight Torque (Tr): The torque component seen at the gear box output shaft due to the counterweight normal force.

Torque Command (Tc): The final torque command to the drive system controlling the pump motor.

Torque Factor (Tf): A factor that, when multiplied by the load at the polished rod, gives the torque at the crankshaft of the pumping unit reducer.

Total Reflected Inertia (Jt): The inertia seen at the motor shaft consisting of motor inertia and associated high speed components and the reflected inertias of the counterweight mass and beam mass.

Unbalanced Force (Bu): The force that would be required to bring the beam of the pumping unit to a horizontal position if the unit had no counterbalance.

Velocity Request (Wx): The pumping unit prime mover operator requested run speed.

Velocity Command (Wy): The pumping unit prime mover command velocity. This signal is a conditioned version of the operator requested run speed, and originates in the drive control software.

DETAILED DESCRIPTION OF THE PREFERRED EMBODIMENTS

Figure 1:
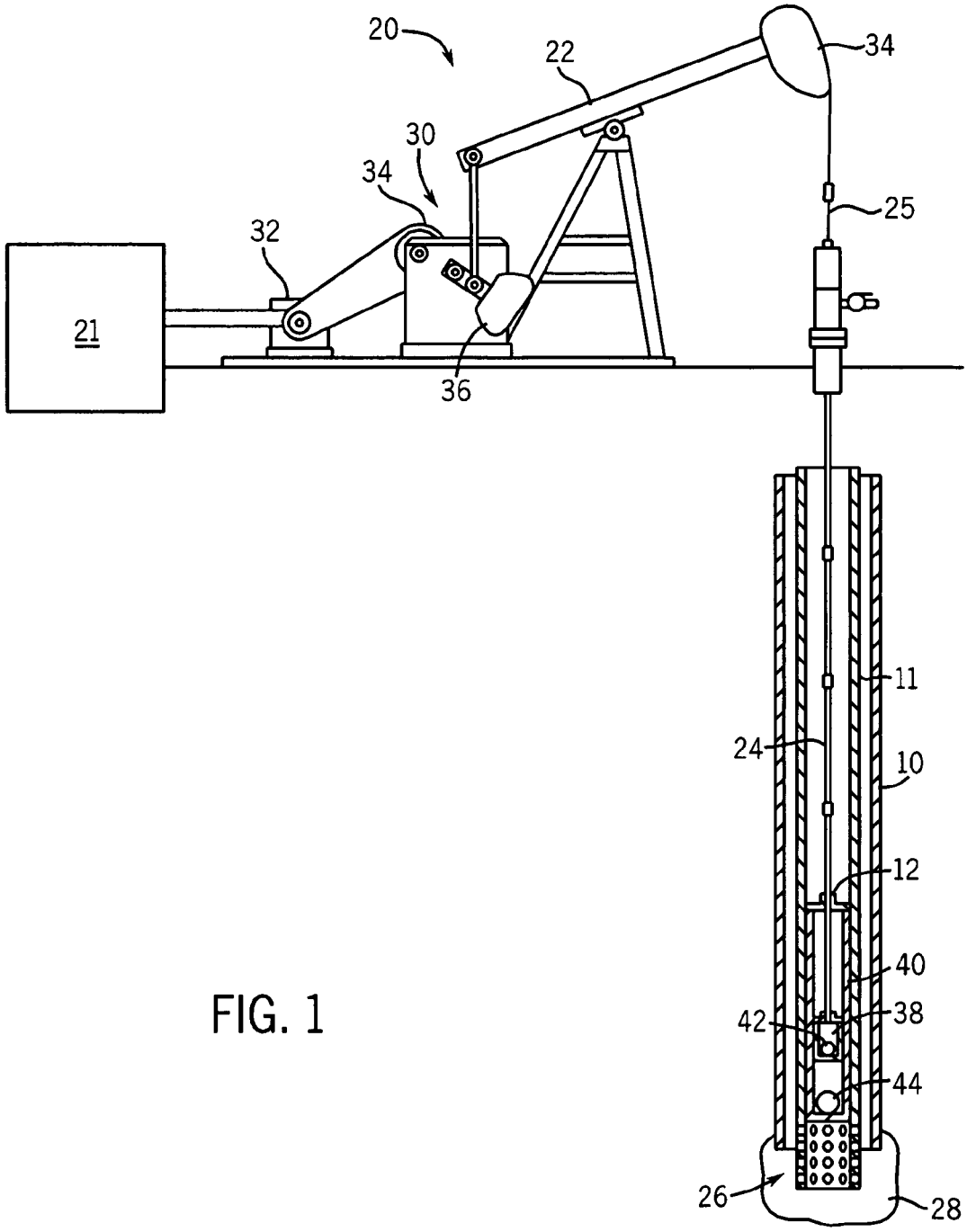
FIG. 1 is a simplified representation of a rod pump system including a rod pump control system that includes a parameter estimator in accordance with the present invention.

Referring to FIG. 1, there is shown a rod pump system 20, the operation of which is controlled by a rod pump control system and method including a parameter estimator in accordance with the present invention. For purposes of illustration, the rod pump control system 21 is described with reference to an application in a rod pump system 20 that includes a conventional beam pump. The beam pump has a walking beam 22 that reciprocates a rod string 24 that includes a polished rod portion 25. The rod string 24 is suspended from the beam for actuating a downhole pump 26 that is disposed at the bottom of a well 28. However, the rod pump control system and method provided by the invention are applicable to any system that uses an electric motor to reciprocate a rod string, including those that drive the rod through belt or chain drives. For example, a belt driven pumping unit includes a belt that is coupled to a rod string for reciprocating the rod string vertically within a well as the belt is driven by a motor.

The walking beam 22, in turn, is actuated by the pitman arm 31 which is reciprocated by a crank arm 30 driven by an electric motor 32 that is coupled to the crank arm 30 through a gear reduction mechanism, such as gearbox 34. The typical motor 32 can be a three-phase AC induction motor operable at 460 VAC and developing 10-125 horsepower, depending upon the capacity and depth of the pump. Other types of motors such as synchronous motors can be used to drive the pumping unit. The gearbox 34 converts motor torque to a low speed but high torque output for driving the crank arm 30. The crank arm 30 is provided with a counterweight 36 that serves to balance the rod string 24 suspended from the beam 22 in the manner known in the art. Counterbalance can also be provided by an air cylinder such as those found on air-balanced units. Belted pumping units may use a counterweight that run in the opposite direction of the rod stroke or an air cylinder for counterbalance.

The downhole pump 26 is a reciprocating type pump having a plunger 38 attached to the end of the rod string 24 and a pump barrel 40 which is attached to the end of tubing in the well 28. The plunger 38 includes a traveling valve 42 and a standing valve 44 positioned at the bottom of the barrel 40. On the up stroke of the pump, the traveling valve 42 closes and lifts fluid, such as oil and/or water, above the plunger 38 to the top of the well and the standing valve 44 opens and allows additional fluid from the reservoir to flow into the pump barrel 40. On the down stroke, the traveling valve 42 opens and the standing valve 44 closes in preparation of the next cycle. The operation of the pump 26 is controlled so that the fluid level maintained in the pump barrel 40 is sufficient to maintain the lower end of the rod string 24 in the fluid over its entire stroke.

Figure 2:
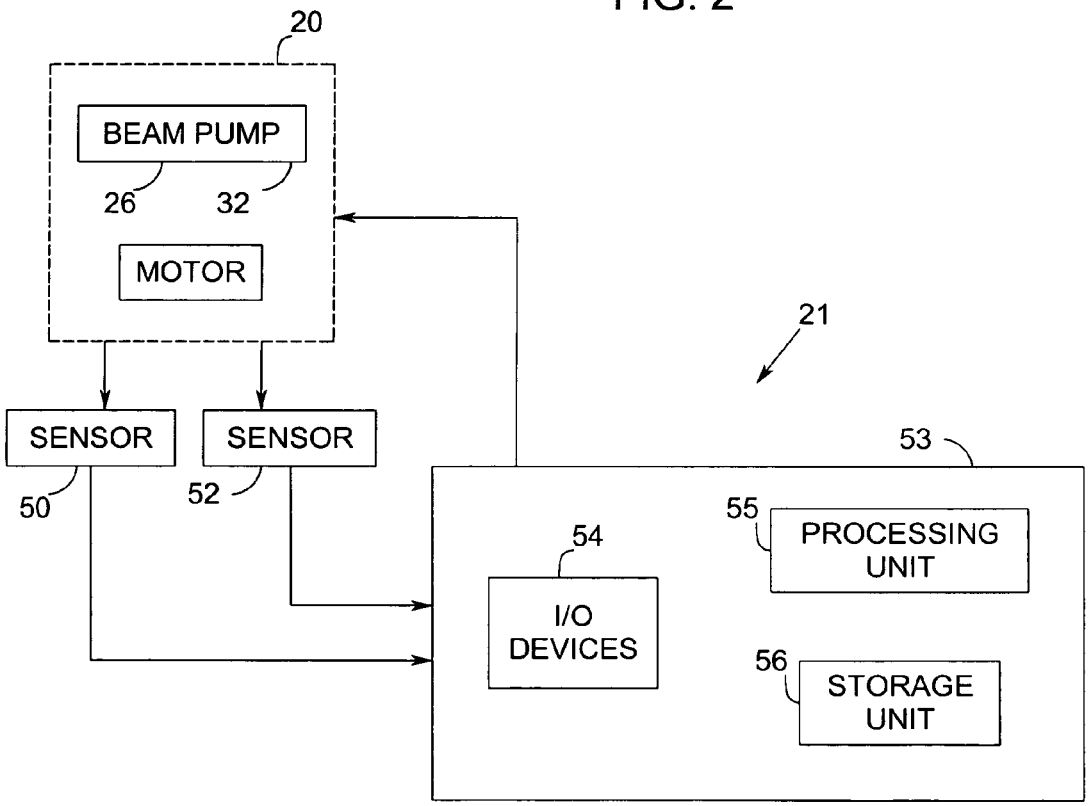
FIG. 2 is a block diagram of the rod pump control system of FIG. 1.

Referring to FIG. 2, which is a simplified representation of the rod pump control system 21 including parameter estimator in accordance with the present invention, the parameter estimator determines parameters relating to operation of the rod pump from motor data without the need for external instrumentation. In one embodiment, instantaneous motor currents and voltages together with pump parameters are used in determining rod position and load without the need for strain gauges, load cells, or position sensors as well as determining pump pressure and pump flow without the need for additional downhole or surface sensors. The rod position and load can be used to control the operation of the pump 26 to optimize the operation of the pump 26. In addition, American Petroleum Institute (API) specifications have been used to define the pump geometry that allows the use of readily available data from pump manufacturers. System identification routines are used to establish installation dependent parameters specific to the particular pump used in calculating performance parameters that are used in real-time closed loop control of the operation of the rod pump, obviating the need to create large look-up tables for parameter values used in calculating performance parameters.

The pump control system 21 includes transducers, such as current and voltage sensors, to sense dynamic variables associated with motor torque and velocity. As shown in FIG. 2, current sensors 50 are coupled to a sufficient number of the motor leads for the type of motor used. The current sensors 50 provide voltages proportional to the instantaneous stator currents in the motor 32. Voltage sensors 52 are connected across to a sufficient number of the motor windings for the type of motor used and provide voltages proportional to the instantaneous voltages across the motor windings. The current and voltage signals produced by sensors 50 and 52 are supplied to a processor 53 through suitable input/output devices 54. The processor 53 further includes a processing unit 55 and storage devices 56 which stores programs and data files used in calculating operating parameters and producing control signals for controlling the operation of the rod pump system 20. This control arrangement provides nearly instantaneous readings of motor velocity and torque which can be used for both monitoring and real-time, closed-loop control of the rod pump. For example, in one embodiment, computations of motor velocity and torque used for real-time, closed-loop control are provided at the rate of 1000 times per second.

Motor currents and voltages are sensed to determine the instantaneous electric power level drawn from the power source by the electric motor operating the well pump. As the rod string 24 that drives the downhole pump 26 is raised and lowered during each cycle, the motor 32 is cyclically loaded. Depending on the particular pump installation configuration, the walking beam 22 is at a known position during maximum and minimum motor loads. The timing of these maximums and minimums can define the operational pumping frequency and, by integration of the motor velocity in light of the motor to crank gearing, it is possible to estimate the phase position of the pump crank at any time. By monitoring the variances of the motor currents and voltages as a function of pump crank angle, the voltage and current variances can be used together with parameters related to pump geometry to calculate estimates of rod position Xr and rod load Fr.

Figure 3:
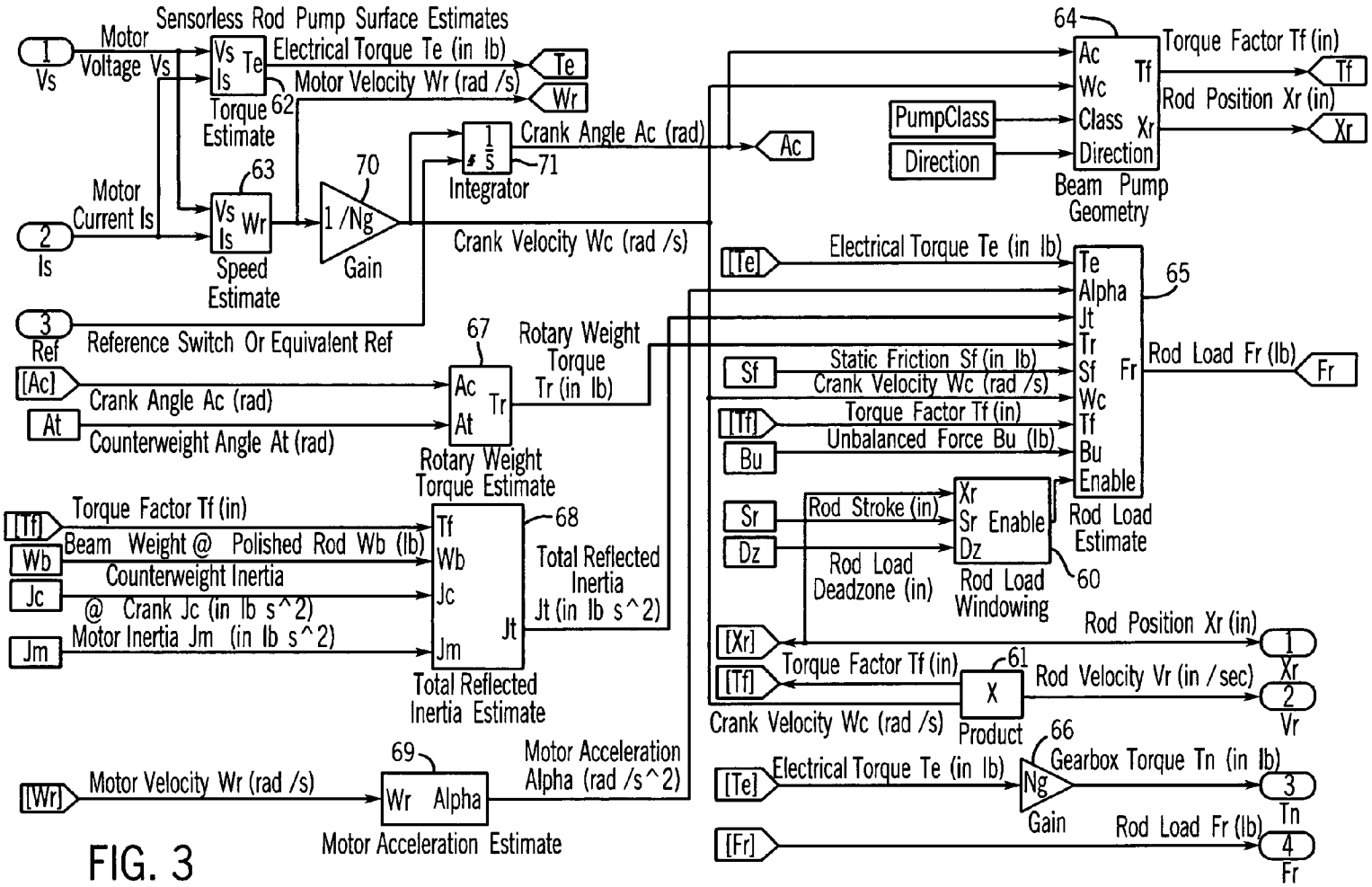
FIG. 3 is a block diagram of the parameter estimator of the rod pump control system for calculating values including gearbox torque, polished rod load, and rod position using parameters of the drive motor and rod pumping unit in accordance with the present invention.

Referring to FIG. 3, there is shown a block diagram of a parameter estimator 23 of the rod pump control system 21 for calculating estimates of parameters including rod position Xr, rod load Fr, and gearbox output torque Tn. In one preferred embodiment, the calculation is carried out by the processing unit 55 (FIG. 2) under the control of software routines stored in the storage devices 56. Block 62 responds to signals corresponding to instantaneous values of motor current and voltage to produce a measure of electrical torque Te of the drive motor 32. Block 63 responds to the signals corresponding to instantaneous values of motor current and voltage to produce an estimate of velocity Wr of the drive motor 32. Block 64 calculates rod position Xr and torque factor Tf. Block 65 calculates an estimate of rod load Fr. Block 67 calculates an estimate of rotary weight torque Tr. Block 68 calculates total reflected inertia Jt. Block 69 produces an output corresponding to acceleration Alpha of the drive motor shaft.

More specifically, blocks 62 and 63 can include hardware circuits which convert and calibrate the motor current and voltage signals provided by the sensors or transducers 50 and 52 (FIG. 2) into current and flux signals. The hardware circuits scale and translate the current and flux signals into an internal frame of reference. After scaling and translation, the outputs of the voltage and current sensors can be digitized by an analog to digital converter. Block 62 combines the scaled signals with motor equivalent circuit parameters to produce a precise measure of electrical torque Te. Automatic identification routings can be used to establish the motor equivalent circuit parameters. Block 63 combines the scaled signals with motor equivalent circuit parameters to produce a precise measure of motor velocity Wr.

In one embodiment, the stator flux is calculated from motor voltages and currents and the electromagnetic torque is directly estimated from the stator flux and stator current. Three-phase motor voltages and currents are converted to dq (direct/quadrature) frame signals using three to two phase conversion for ease of computation in a manner known in the art. Signals in the dq frame can be represented as individual signals or as vectors for convenience. Block 62 responds to motor stator voltage vector Vs and motor stator current vector Is to calculate a measure of electrical torque Te produced by the motor. In one embodiment, the operations carried out by block 62 for calculating the electrical torque estimate are as follows. The stator flux vector Fs is obtained from the motor stator voltage Vs and motor stator current Is vectors according to equation (2):

$$Fs=(Vs-Is\cdot Rs)/s \tag{2}$$

$$Fds=(Vds-Ids\cdot Rs)/s \tag{2A}$$

$$Fqs=(Vqs-Iqs\cdot Rs)/s \tag{2B}$$

where Rs is the stator resistance and s is the Laplace operator for differentiation. Equation (2A) and (2B) show typical examples of the relationship between the vector notation for flux Fs, voltage Vs, and current Is and actual d axis and q axis signals.

In one embodiment, the electrical torque Te is estimated directly from the stator flux vector Fs obtained from equation (2) and the measured stator current vector Is according to equation (3) or its equivalent (3A):

$$Te=Ku\cdot(3/2)\cdot P\cdot Fs\times Is \tag{3}$$

$$Te=Ku\cdot(3/2)\cdot P\cdot(Fds\cdot Iqs-Fqs\cdot Ids) \tag{3A}$$

where P is the number of motor pole pairs and Ku is a unit scale factor to get from MKS units to desired units.

In one embodiment, rotor velocity Wr is obtained from estimates of electrical frequency We and slip frequency Ws. The inputs to block 63 also are the stator voltage Vs and stator current Is vectors. Block 63 calculates the motor velocity Wr. In one embodiment, the operations carried out by block 63 for calculating the motor velocity are as follows. A rotor flux vector Fr is obtained from the measured stator voltage Vs and stator current Is vectors along with motor stator resistance Rs, stator inductance Ls, magnetizing inductance Lm, and rotor inductance Lr according to equations (4) and (5); separate d axis and q axis rotor flux calculations are shown in equations (5A) and (5B) respectively:

$$\text{Sigma}Ls=Ls-Lm\hat{}2/Lr \tag{4}$$

$$Fr=(Lr/Lm)\cdot[Fs-Is\cdot\text{Sigma}Ls] \tag{5}$$

$$Fdr=(Lr/Lm)\cdot(Fds-\text{Sigma}Ls\cdot Ids) \tag{5A}$$

$$Fqr=(Lr/Lm)\cdot(Fqs-\text{Sigma}Ls\cdot Iqs) \tag{5B}$$

The slip frequency Ws can be derived from the rotor flux vector Fr, the stator current vector Is, magnetizing inductance Lm, rotor inductance Lr, and rotor resistance Rr according to equation (6):

$$Ws = Rr\cdot(Lm/Lr)\cdot\frac{[Fdr\cdot Iqs - Fqr\cdot Ids]}{Fdr\hat{}2 + Fqr\hat{}2} \tag{6}$$

The instantaneous excitation or electrical frequency We can be derived from stator flux according to equation (7):

$$We = \frac{Fds\cdot sFqs - Fqs\cdot sFds}{Fds\hat{}2 + Fqs\hat{}2} \tag{7}$$

The rotor velocity or motor velocity Wr can be derived from the slip frequency Ws and the electrical frequency We according to equation (8):

$$Wr=We-Ws \tag{8}$$

The motor velocity Wr is passed through an amplifier 70 and divided by the gain Ng which represents the overall gear ratio between the motor and the pump crankshaft. Consequently, the motor velocity Wr that has been obtained from motor voltage and current is converted to crank velocity Wc, which reflects the overall pumping unit gear ratio, that is being produced at the output of the gearbox 34.

The crank velocity Wc is integrated in block 71 to obtain a position which, when combined with the overall pumping unit gear and a reference position, yields the angular position that is the crank angle Ac of the pumping unit gearbox. The reference position can be obtained using a magnetic or optical sensing device, a cam limit switch, or similar device, to define a reference point within the stroke of the pumping unit for each cycle of operation.

Block 64 calculates the rod position Xr and the torque factor Tf using the crank angle Ac obtained from the crank velocity Wc, and parameters associated with beam pump geometry. As is known, the geometry of the pumping unit is defined by the American Petroleum Institute and can be entered directly into the control in that format. One source of API specifications is API Specification 11E, entitled "Specification for Pumping Units", seventeenth edition, Nov. 1, 1994. Information entered is dependent upon the class of the rod pump and direction of rotation. Typical beam pump parameters that are used for calculating the rod position Xr include the dimensions of the walking beam, crank radius, and pitman arm as well as the location of the various pivot points in the unit. Those pump parameters are readily available from pumping unit manufacturers. Simple parameters are also included in the control for belt type pump mechanisms that are not specified by the API standard. Automatic identification routings are used to establish installation dependent pumping unit parameters such as counterbalance inertia and frictional terms.

Figure 4:
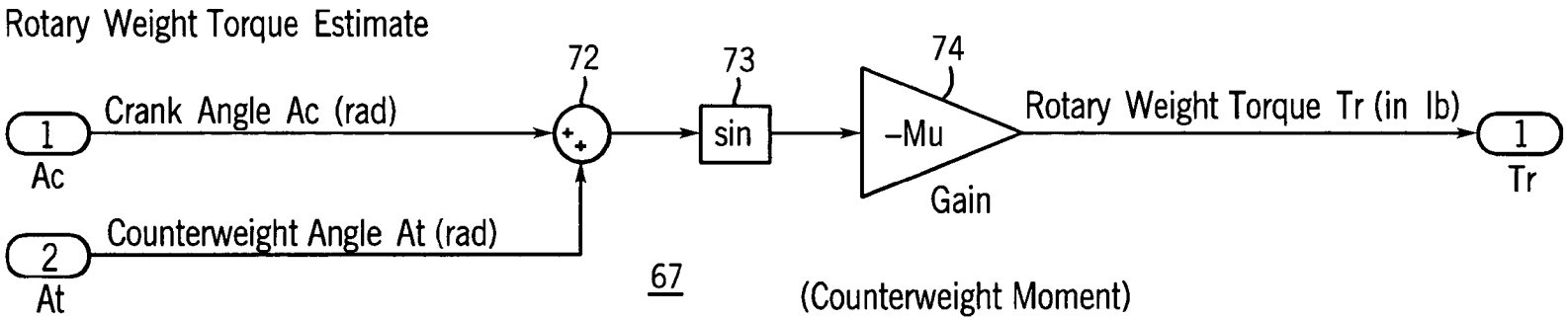
FIG. 4 is a block diagram of a process for obtaining an estimate of rotary weight torque for the process of FIG. 3.

Block 67 combines the crank angle Ac with the counterweight angle At to produce an estimate of rotary torque Tr associated with the weight of the counterweight. Referring to FIG. 4, in one embodiment, the rotary torque Tr is obtained by summing the crank angle Ac with the counterweight angle At using summing block 72. Block 73 obtains the sine of the resultant value. The result is passed through amplifier 74, the gain −Mu of which is selected to correspond to the counterweight moment, producing the rotary torque Tr.

Figure 5:
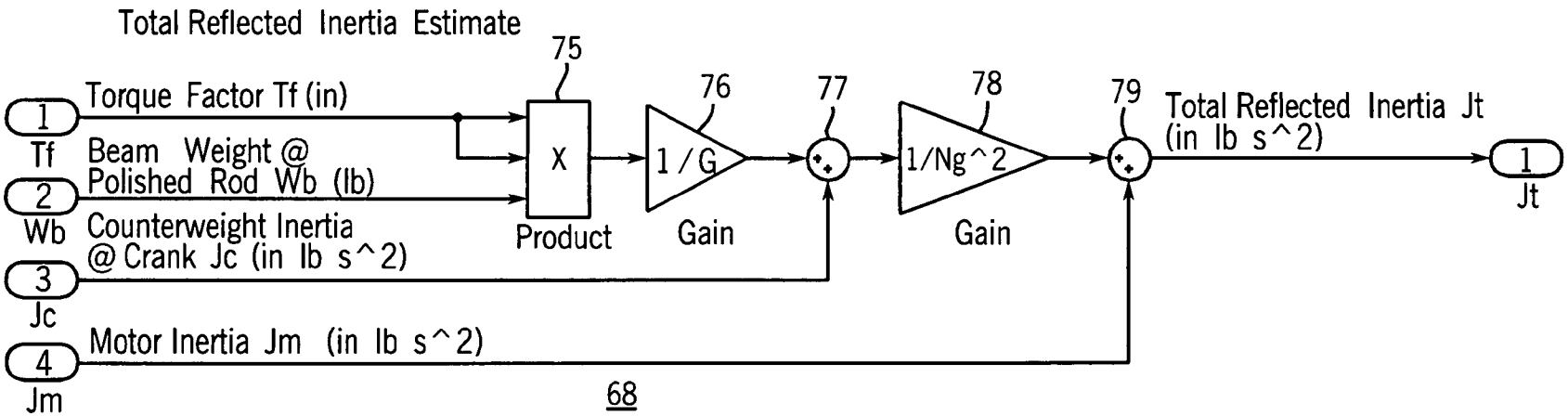
FIG. 5 is a block diagram of a process for obtaining an estimate of total reflected inertia for the process of FIG. 3.

Referring to FIGS. 3 and 5, block 68 combines torque factor Tf, produced by block 64, beam weight Wb, counterweight inertia Jc and motor inertia Jm to produce total reflected inertia Jt. With reference to FIG. 5, block 75 obtains the product of torque factor Tf and equivalent beam weight Wb. Torque factor Tf is entered twice to square that factor. In one embodiment, the gain of amplifier 76 is 1/G which divides the product by the acceleration of gravity such that output of amplifier 76 is the articulating inertia of the pumping unit. The result is combined with counterweight inertia Jc at the crank in summing block 77 and scaled by amplifier 78, the gain 1/Ng^2 of which is selected to correspond to the inverse square of the overall gear ratio. The scaled value is combined with motor inertia Jm by summing block 79 to obtain the estimate of total reflected inertia Jt.

Figure 6:
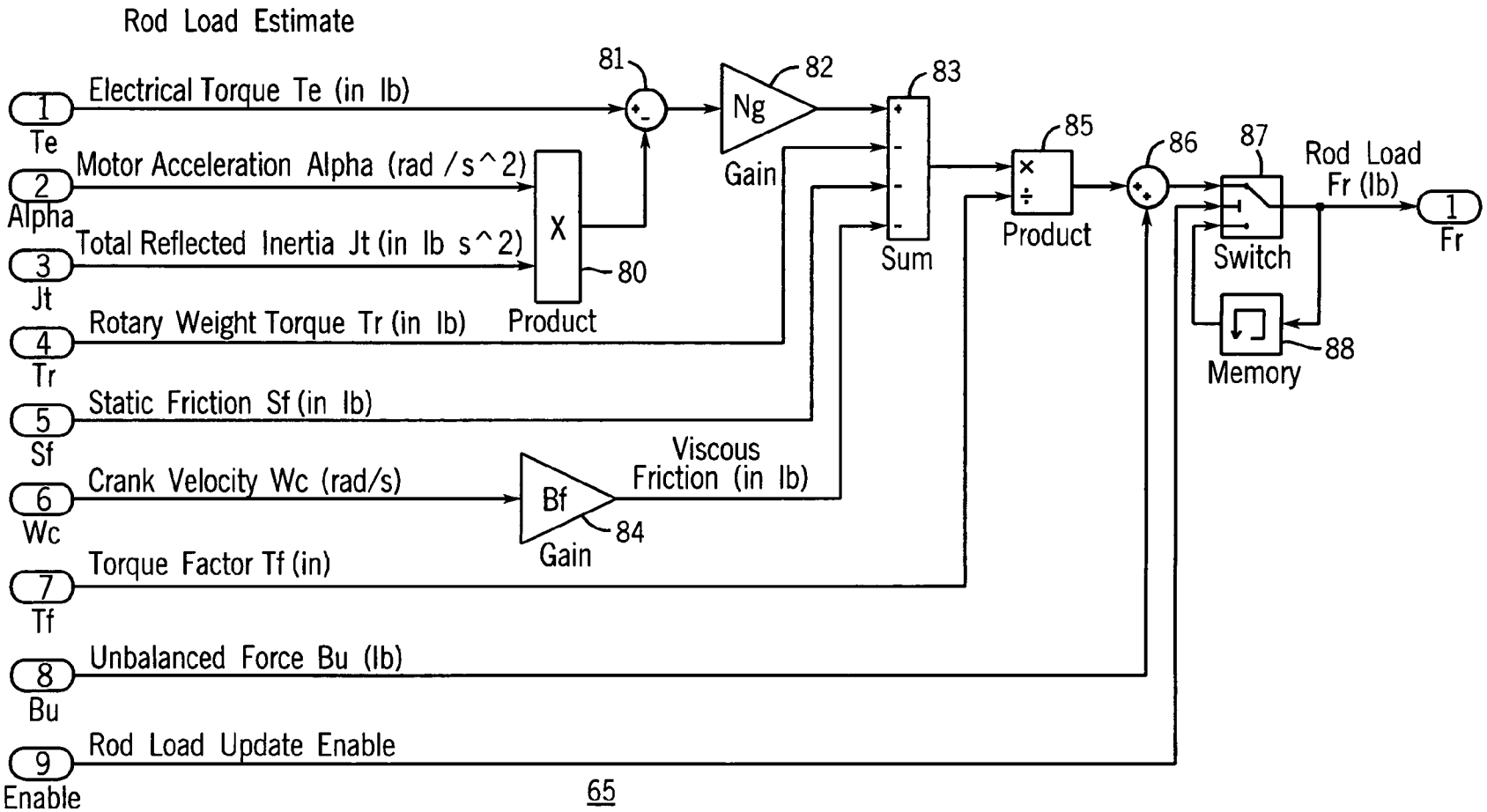
FIG. 6 is a block diagram of a process for obtaining an estimate of rod load for the process of FIG. 3.

Referring to FIGS. 3 and 6, block 65 combines electrical torque Te calculated by block 62, rotary weight torque estimate Tr calculated by block 67, an estimate of total reflected inertia Jt calculated by block 68, motor acceleration estimate Alpha, produced by block 69, torque factor Tf from block 67, static friction Sf, crank velocity Wc from amplifier 70, viscous friction factor Bf, and unbalanced force Bu to produce the rod load estimate Fr. With reference to FIG. 6, block 80 obtains the product of motor acceleration estimate Alpha and an estimate of total reflected inertia Jt at the motor, the result of which is subtracted from the electrical torque Te by summing block 81. This difference is scaled by a factor corresponding to the gearbox ratio Ng, using amplifier 82. The difference between electrical torque as modified by motor acceleration and load inertia factor, provided by amplifier 82 minus the static torque Sf, provided by setup testing, and viscous torque, provided by multiplying in amplifier 84 the crank speed Wc by a viscous friction factor Bf determined during setup, and rotary weight torque Tr is divided by the torque factor Tf in block 85, and the result is summed with unbalanced force Bu in summing block 86 to produce rod load estimate Fr. A rod load update enable switch 87 and memory element 88 are used to hold the prior value of rod load at around the points where the torque factor Tf goes to zero as determined by the rod load update enable output of block 60 detailed in FIG. 7.

Figure 7:
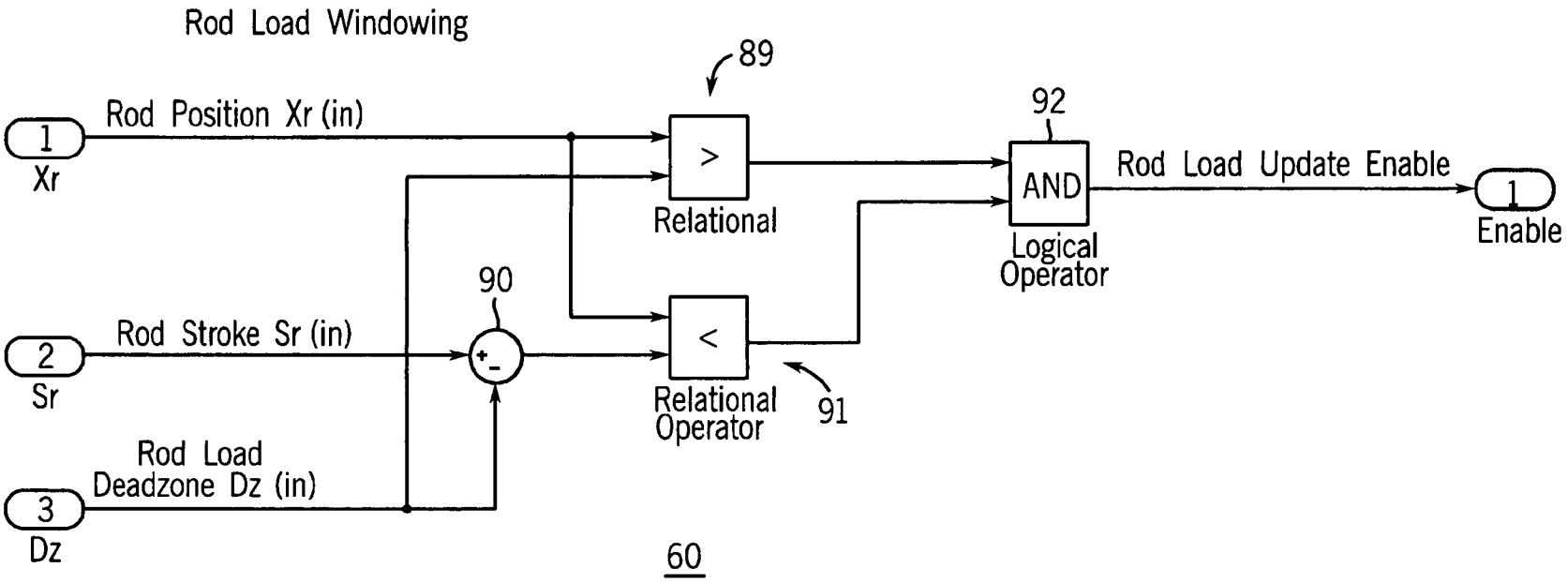
FIG. 7 is a block diagram of a process for selecting rod stroke regions that have torque factors of sufficient magnitude to produce accurate measurement of rod load as the rod load windowing of FIG. 3.

Referring to FIGS. 3 and 7, block 60 compares the rod position to the positions defined by the ends of the rod stroke Sr determined during setup. If the rod position is within the deadzone Dz of either end of the stroke, the rod load update enable output is off and block 65 (FIG. 6) is inhibited from updating the rod load Fr. Deadzone Dz is also determined during setup. With reference to FIG. 7, relational operator 89 compares the current value of rod position Xr to the rod load deadzone value Dz and outputs a logical true if Xr is greater than Dz. Summing block 90 subtracts the rod load deadzone value Dz from the rod stroke Sr. Relational operator 91 compares the current value of rod position Xr to the output of summing block 90 and outputs a logical true if Xr is the lesser value. Logical operator 92 outputs a logical true only if both relational operators 89 and 91 are outputting logical trues.

Referring again to FIG. 3, the gearbox output torque Tn can be computed from the electrical torque Te produced by block 62 by using the overall gearbox ratio. The value of electrical torque Te produced by block 62 is multiplied by a factor related to gearbox ratio Ng, using an amplifier 66, to provide an estimate of gearbox output torque Tn.

Block 69 produces an output corresponding to acceleration Alpha of the drive motor shaft. One method to obtain motor acceleration in Alpha Block 69 is to differentiate the motor velocity Wr.

Multiplier block 61 produces an output corresponding to rod velocity Vr by computing the product of torque factor Tf and crank velocity Wc.

Figure 8:
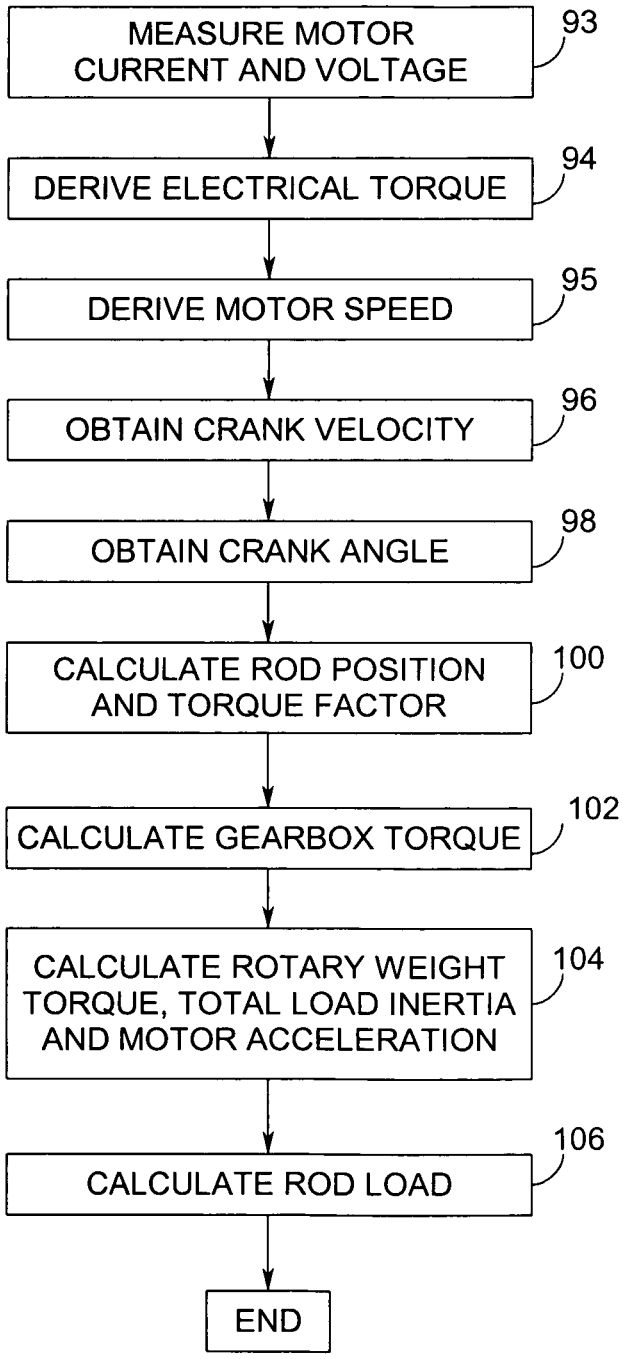
FIG. 8 is a process flow chart for calculating polished rod load and rod position for the pump system of FIG. 1, in accordance with the present invention.

Referring to FIG. 8, there is shown a process flow diagram for obtaining estimates of polished rod position Xr, polished rod load Fr, and gearbox torque Tn derived from the motor current and voltage in accordance with the invention. At start-up, automatic identification routines are used offline to estimate various parameters. In one embodiment, the automatic identification routines determine overall gear ratio Ng and counterweight moment Mu for use in further calculations. The overall gear ratio is the difference between the motor revolutions and the crank cycle. The automatic identification routines also are used to establish motor equivalent circuit parameters as well as installation dependent pumping unit parameters, such as static friction torque Sf and viscous friction factor Bf.

Referring also to FIG. 3, after initialization, block 93 obtains the instantaneous values of motor stator current and motor stator voltage from sensors 50 and 52, respectively. As described above, blocks 62 and 63 respond to the motor current and voltage signals from the sensors 50 and 52 for use in calculating motor torque and velocity. Motor stator current and voltage are measured continuously allowing the instantaneous values of current and voltage to be obtained through the measurement.

In block 94, the values of instantaneous motor current and motor voltage obtained from the measurements are used to derive electrical torque Te. In one embodiment, the stator flux is derived from the motor currents and voltages, using equation (2) as described above. The electrical torque Te can be directly estimated from this stator flux and the motor current measured, using equation (3).

In block 95, the values of instantaneous motor current and motor voltage obtained from the measurements are used to derive motor velocity Wr. In one embodiment, rotor flux is obtained from the measured voltage and current, and stator resistance and inductance, using equations (4) and (5) as has been described. Then, slip frequency is derived from the rotor flux, the measured motor current, magnetizing inductance, rotor inductance, and rotor resistance using equation (6). An estimate of electrical frequency is derived from the stator flux using equation (7) as described above. Then, motor velocity Wr is derived from the slip frequency and the electrical frequency using equation (8) as described above.

The motor velocity Wr obtained in block 95 is used to obtain crank velocity Wc in block 96. In one embodiment, the crank velocity is obtained by scaling the motor velocity as described above with reference to FIG. 3.

In block 98, the crank angle Ac is obtained by integrating the crank velocity Wc obtained in block 96. A limit switch or similar device may be used to determine a reference point within the stroke of the pumping unit. The crank velocity Wc is integrated to get position that combined with the overall pumping unit gear ratio and reference position give the crank angle Ac.

In block 100, rod position Xr is calculated using the crank angle Ac together with parameters associated with pumping unit geometry as described above with reference to FIG. 3. The use of the system parameters with crank angle Ac allows the calculation of rod position Xr.

In block 102, the gearbox torque Tn is calculated using the electrical torque Te obtained from block 92. The overall gear ratio Ng is also used to compute gearbox output torque Tn from motor electrical torque Te.

In block 104, the rotary weight torque Tr, is calculated by block 67, the total reflected inertia Jt, is calculated by block 68, and motor acceleration Alpha is calculated by block 69.

In block 106, the combination of the system parameters and pumping unit geometry with electrical torque Te provides the computation of rod load Fr. The electrical torque estimate Te is used to obtain the rod load estimate Fr.

The method of estimating the load and position of the polished rod at the surface is possible without requiring down hole sensors, echo meters, flow sensors, etc. The values of polished rod load and position can be commonly plotted in XY format to produce a surface dynamometer card. The estimation method is a real-time, continuously updating method, i.e., it is not performed off-line in a batch manner. Moreover, the method of estimating a surface dynamometer card for a rod pump unit does not employ any load or position transducers.

Figure 13:
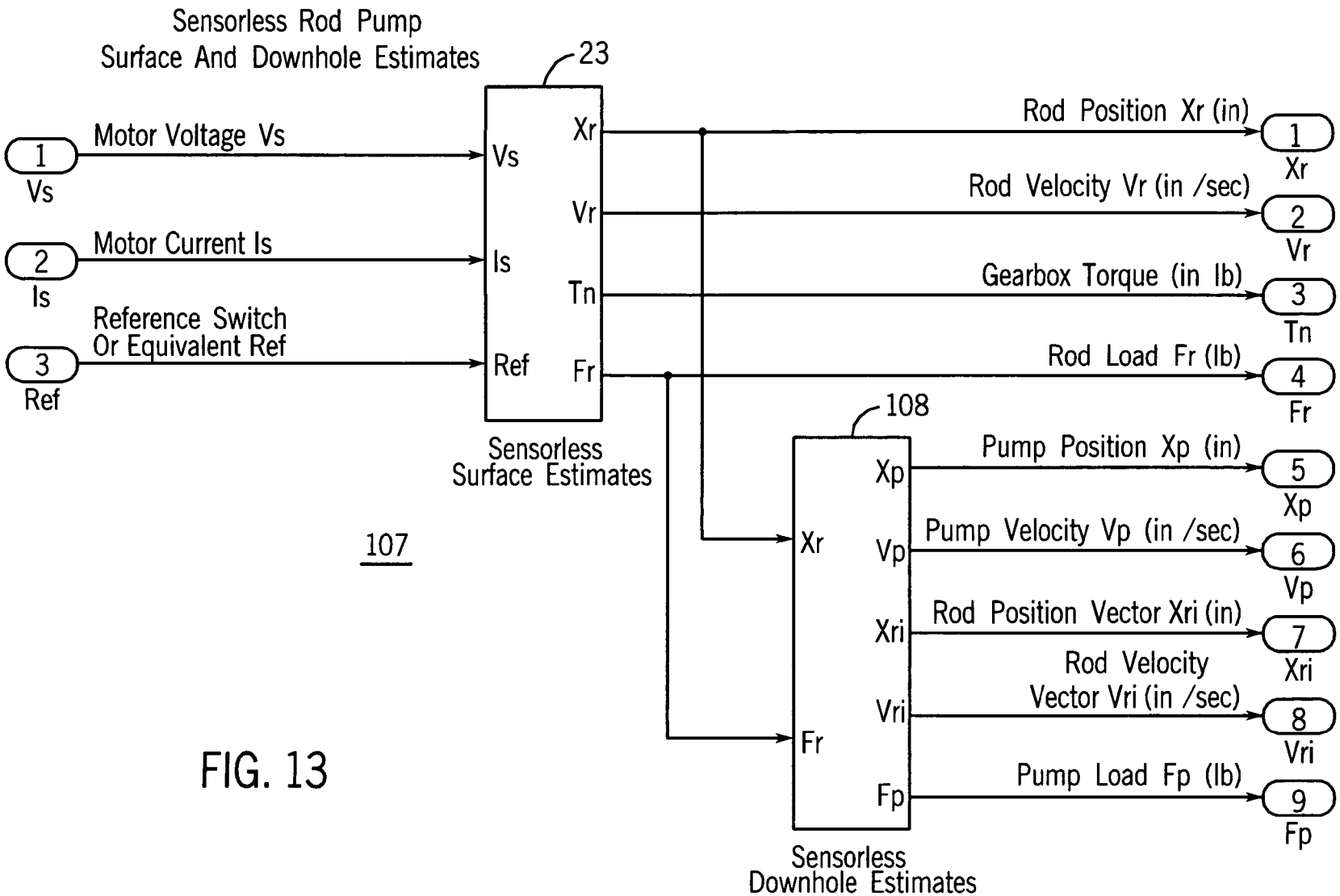
FIG. 13 is a block diagram of a system for estimation of rod pump surface and downhole dynamometer cards for the rod pumping unit in accordance with the present invention.

In accordance with a further aspect of the invention, the values of polished rod load and position can be used to produce a downhole dynamometer card estimate without the need for sensors. Referring to FIG. 13, there is shown a block diagram of a system 107 for obtaining a downhole dynamometer card without requiring down hole sensors, echo meters, flow sensors, etc., using the parameter estimator 23 described above. The system 107 includes a downhole dynamometer card estimator, block 108, that uses the polished rod position and the polished rod load parameter values obtained by the parameter estimator 23 to produce an estimation of the downhole dynamometer card. Thus, the downhole dynamometer card estimation is produced without the need for rod position or load transducers. The motor voltage and current output signals obtained from measurements of the motor voltage and current are used to derive instantaneous values polished rod load and position which are used in producing the estimated downhole dynamometer card.

The accuracy of the estimation of the downhole pump is dependent upon simulating damping forces that are inherent in sucker rod pump systems. A viscous damping coefficient is used to model these damping forces.

More specifically, in one embodiment, an estimation of the downhole dynamometer card is obtained using the wave equation to model the force trajectory along the rod string in distance and time. The wave equation is a linear hyperbolic differential equation that describes the longitudinal vibrations of a long slender rod. Using the wave equation with viscous damping, the motion of a sucker rod string can be approximated. The wave equation is used only to model the rod string and force travelling through it. The pump sets the boundary conditions for the wave equation at the bottom and the surface prime mover sets the boundary conditions for the wave equation at the top. The continuous form of the wave equation with constant rod diameter is:

$$v^2\frac{\partial^2 u}{\partial x^2} = \frac{\partial^2 u}{\partial t^2} + C\frac{\partial u}{\partial t} \tag{9}$$

where u is the rod displacement, x is the axial distance along the length of the rod, c is the damping coefficient, and v is the velocity of force propagation in the rods.

Details of the use of the wave equation in estimating a downhole dynamometer card are disclosed, for example, in a paper entitled "An Improved Finite-Difference Calculation of Downhole Dynamometer Cards for Sucker-Rod Pumps", by T. A. Everitt and J. W Jennings, SPE 18189, SPE Production Engineering, February 1992, pages 121-127. For simplicity, Equation (9) is for the case of a constant rod diameter. However, as disclosed in the referenced paper of T. A. Everitt and J. W Jennings, with modification, this method can also account for variable rod diameter, including tapered rod-strings and rod strings of variable density, e.g., steel or fiberglass. Solving the wave equation requires only two boundary conditions because only steady state solutions are needed. The typical use of the wave equation would be to use sampled data of a surface dynamometer card from a rod pumping systems to do an off-line calculation of the pump downhole dynamometer card. In this invention, the wave equation is solved on-line for each data point so the results can be used in the next sample period for control of the pumping system. The two boundary conditions are polished rod load Fr and position Xr as a function of time. These conditions are produced by the parameter estimator 23.

The damping coefficient c can be similar to that presented by T. A. Everitt and J. W Jennings in the referenced paper, or that presented in U.S. Pat. No. 3,343,409 issued to S. G. Gibbs.

The accuracy of the downhole dynamometer card estimate can be verified by performing simulations. One verification procedure that can be used is similar to that disclosed in the paper by Everitt and Jennings referenced above.

Using the multisection simulation disclosed in the paper by S. G. Gibbs, referenced above, the surface dynamometer card load is estimated from a given surface position trajectory and pump load and position. This method computes new rod position estimates in time. Then, using the finite difference method disclosed by Everitt and Jennings in the paper referenced above, the downhole dynamometer card is estimated from the surface dynamometer card generated previously. Then, the estimated downhole dynamometer card is plotted with the predicted downhole dynamometer card to verify the accuracy of the estimated downhole dynamometer card.

Figure 9:
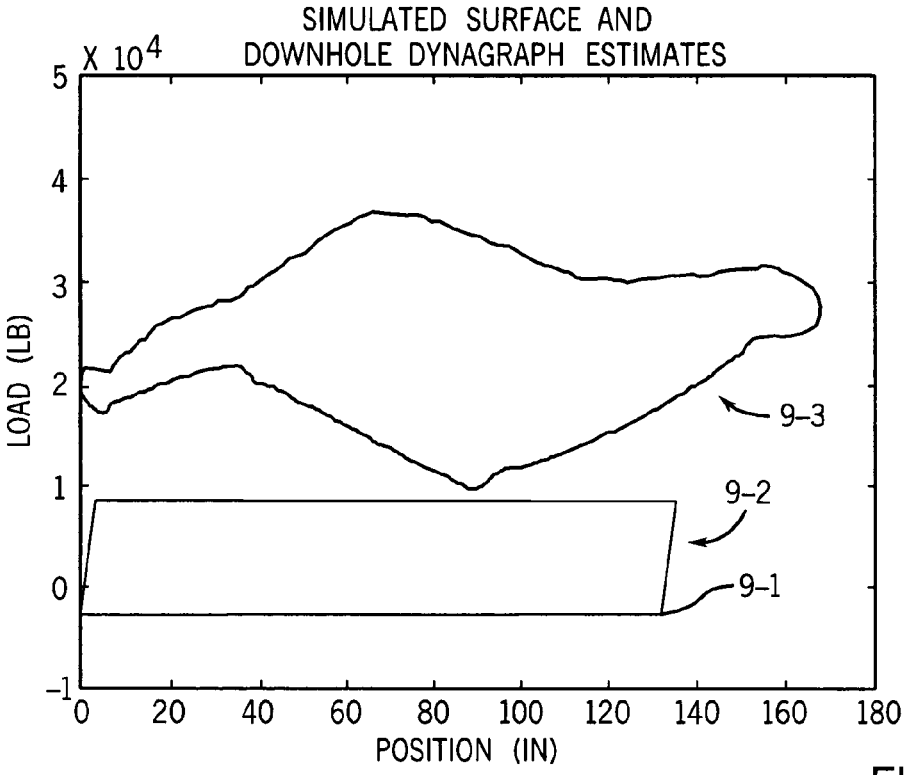
FIG. 9 illustrates a simulated surface and downhole dynamometer card for a conventional beam pump as well as a downhole dynamometer card generated by the wave method of computation.
Figure 10:
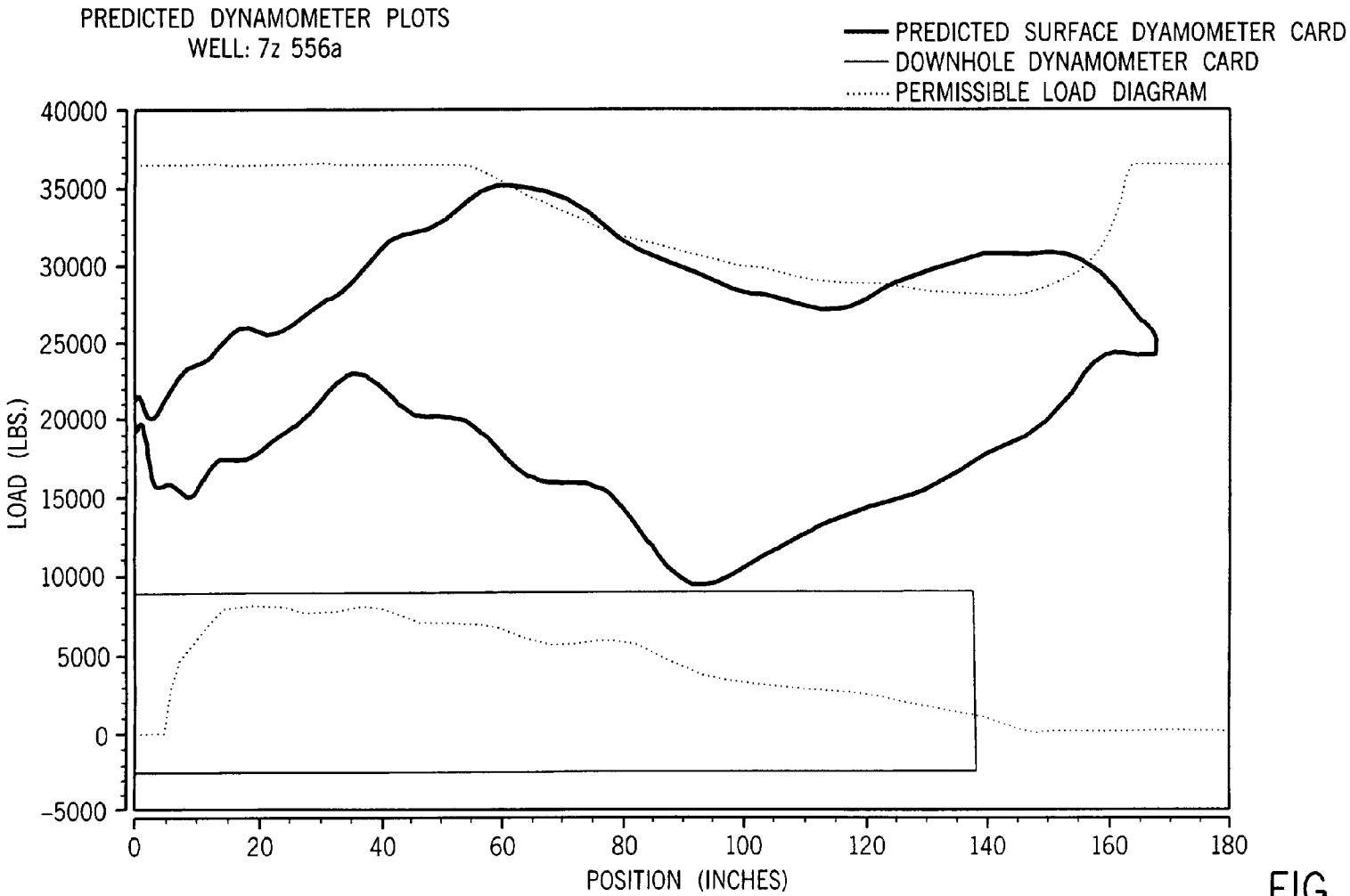
FIG. 10 illustrates simulated surface and downhole dynamometer cards for a conventional beam pump from a commercially available rod pump simulation program.

FIG. 9 demonstrates the ability of the wave equation method to extract downhole pump operation from surface information. An assumed full pump condition indicated by reference number 9-1 was used to simulate surface dynamometer card parameters 9-3. Those parameters were used with the wave equation method to generate the predicted downhole pump dynamometer card 9-2 which closely tracks the originally assumed pump dynamometer card. FIG. 10 shows the results that were obtained using a commercially available simulation program to check the results of the multisection simulation and wave equation shown in FIG. 9

Figure 11:
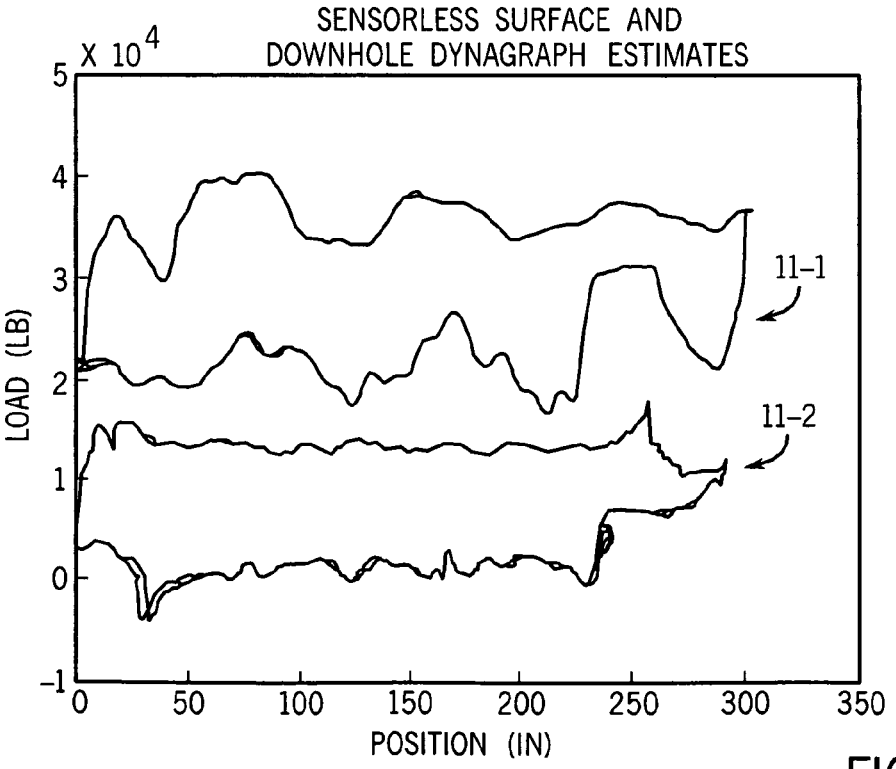
FIG. 11 illustrates a measured surface dynamometer card for a belt driven pump as well as a downhole dynamometer card generated by the wave method of computation.

The foregoing simulations were conducted for a conventional beam type rod pump. However, the finite difference method can be used for estimating the downhole dynamometer card for other types of rod pump units, such as a rod pump unit in which the driver includes a belt drive. FIG. 11 shows results for a pumping unit including a belt that is coupled to a rod string for reciprocating the rod string vertically within a well as the belt is driven by a motor. The graph given by FIG. 11 includes a surface dynamometer card 11-1 obtained from actual field measure data and a predicted downhole dynamometer card 11-2 obtained from the wave equation method. The source data was captured at a constant pump velocity of four strokes per minute.

Figure 12:
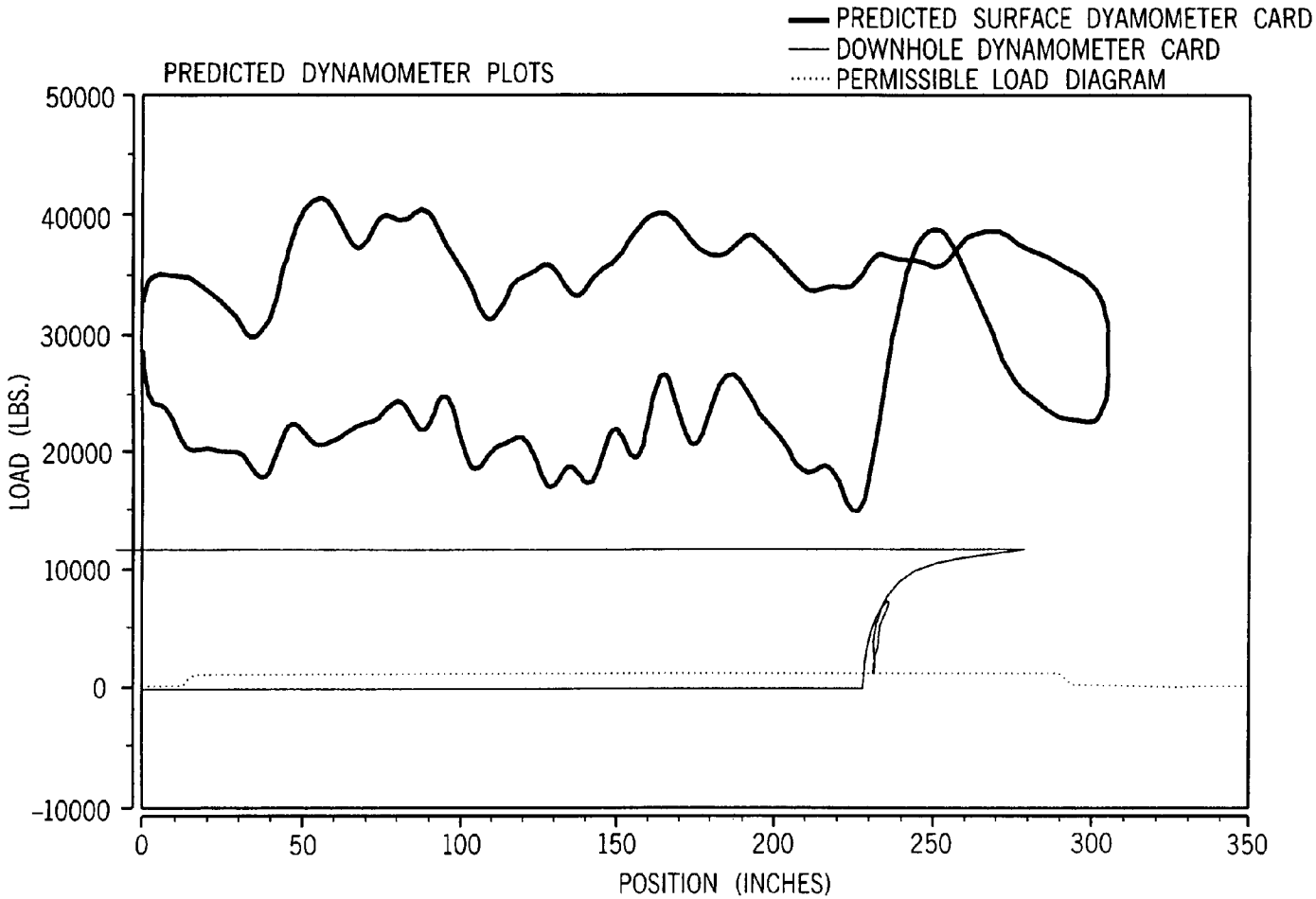
FIG. 12 illustrates simulated surface and downhole dynamometer cards for a belt driven pump from a commercially available rod pump simulation program.

FIG. 12 illustrates results which are similar to those illustrated in FIG. 11 which were obtained using a commercially available simulation program.

The rod load Fr and/or rod position Xr parameters obtained using the parameter estimator can be used to provide various control functions. By way of example, control algorithms can use the rod load, rod position, or both to achieve improved pump operation.

Figure 14:
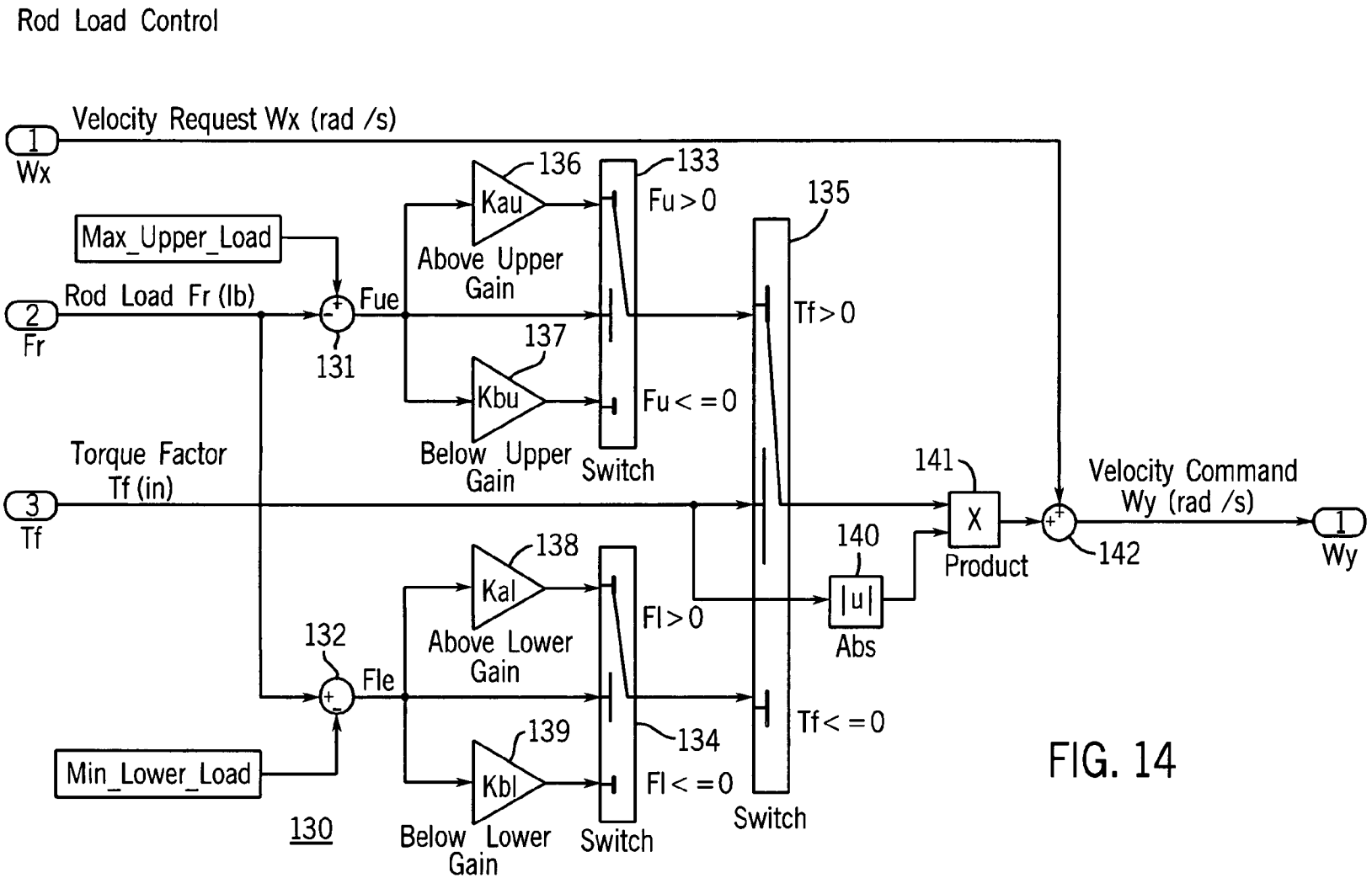
FIG. 14 is a block diagram of a rod load control in accordance with the present invention.

Referring to FIG. 14, there is shown a block diagram of a system 130 for controlling a pump using rod load control. This control algorithm uses the rod load Fr, which can be from the estimator in FIG. 3, along with maximum upper load and minimum lower load parameters to achieve desirable rod loading. Rod loads can be increased in areas of the pump cycle with low rod stress to increase pump stroke and associated production and/or reduced in areas of the pump cycle with high rod stress to avoid rod damage.

When the torque factor Tf, which can be from the estimator in FIG. 3, is positive, the switch 135 causes the upper portion of the control to be selected. Summing block 131 subtracts rod load Fr from the value Max_Upper_Load, which is determined during setup, and outputs the result as Fue. If Fue is greater than zero, switch 133 causes it to be multiplied by the above upper gain Kau in gain block 136. If Fue is less than or equal to zero, switch 133 causes it to be multiplied by the below upper gain Kbu in gain block 137.

Similarly, When the torque factor Tf is zero or negative, the switch 135 causes the lower portion of the control to be selected. Summing block 132 subtracts the value Min_Lower_Load, which is determined during setup from rod load Fr, and outputs the result as Fle. If Fle is greater than zero, switch 134 causes it to be multiplied by the above lower gain Kal in gain block 138. If Fle is less than or equal to zero, switch 134 causes it to be multiplied by the below lower gain Kbl in gain block 138.

Whichever value is calculated is then multipled with the absolute value of torque factor Tf by multiplier block 141. The absolute value of Tf is derived by the absolute value block 140. The output of the multiplier block is added to the velocity request Wx by summing block 142 to generate the velocity command Wy.

Figure 15:
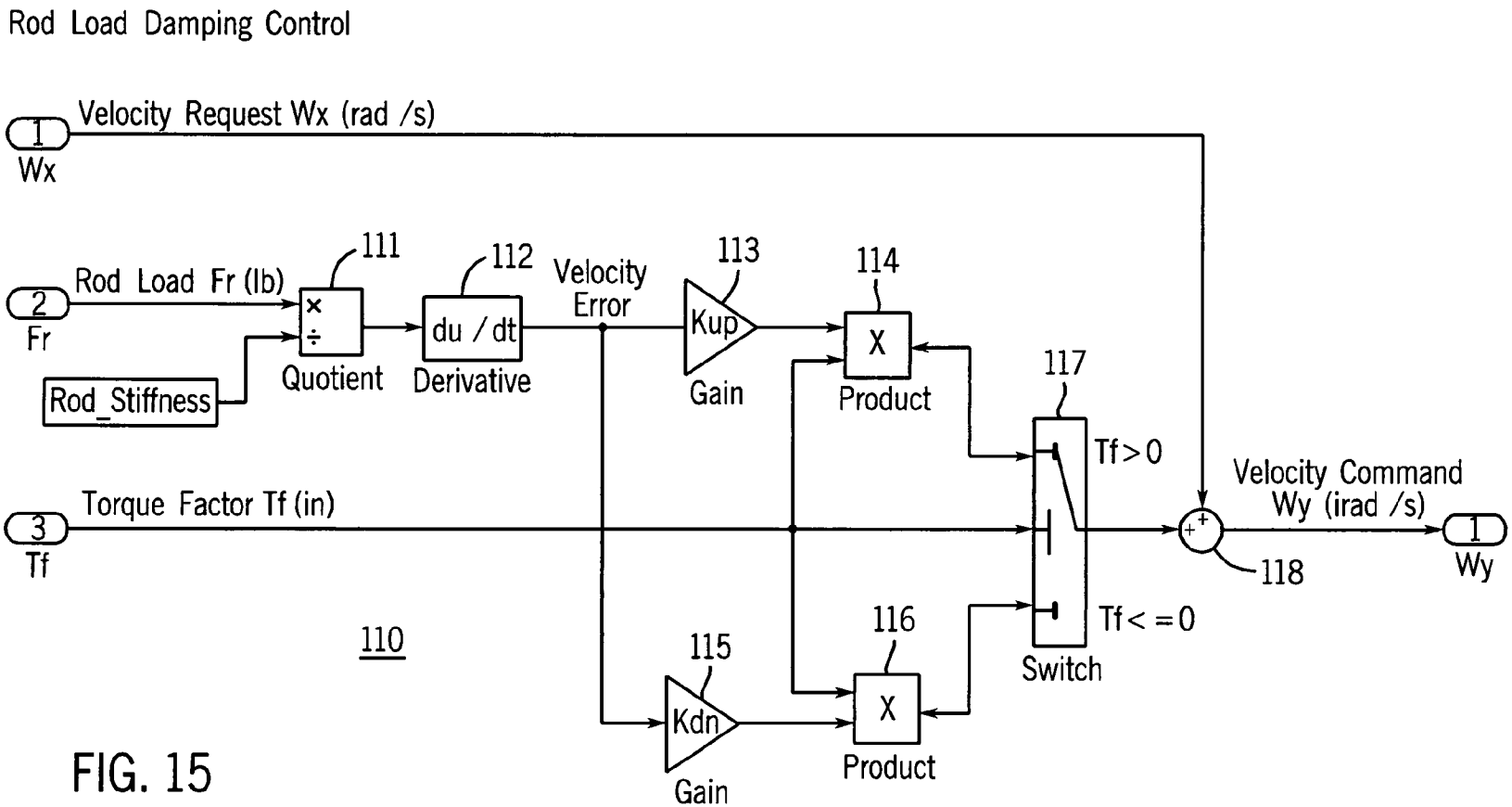
FIG. 15 is a block diagram of a single section simulation model based rod pump control in accordance with the present invention.

Referring to FIG. 15, there is shown the block diagram of a system 110 wherein the rod load Fr parameter, which can be from the estimator in FIG. 3, can be used along with a one section model of the rod string based on rod stiffness to provide a control function referred to hereinafter as a rod load damping control. This control dampens the stress excursions in the rod string and causes the downhole pump motion to more closely follow the motion of the polished rod at the surface. Therefore, efficiency and reliability of the pump system is increased.

Rod load Fr is divided by Rod_Stiffness, which is determined during setup, in division block 111. The result is differentiated by derivative function block 112 producing a velocity error term. If the torque factor Tf, which can be from the estimator in FIG. 3, is greater than zero, switch block 117 causes the velocity error to be multiplied by the gain factor Kup in gain block 113 and then multiplied by the torque factor Tf in multiplier block 114. If the torque factor Tf is less than or equal to zero, switch block 117 causes the velocity error to be multiplied by the gain factor Kdn in gain block 115 and then multiplied by the torque factor Tf in multiplier block 116. The result is then added to the velocity request Wx by summing block 118 to generate the velocity command Wy.

Figure 16:
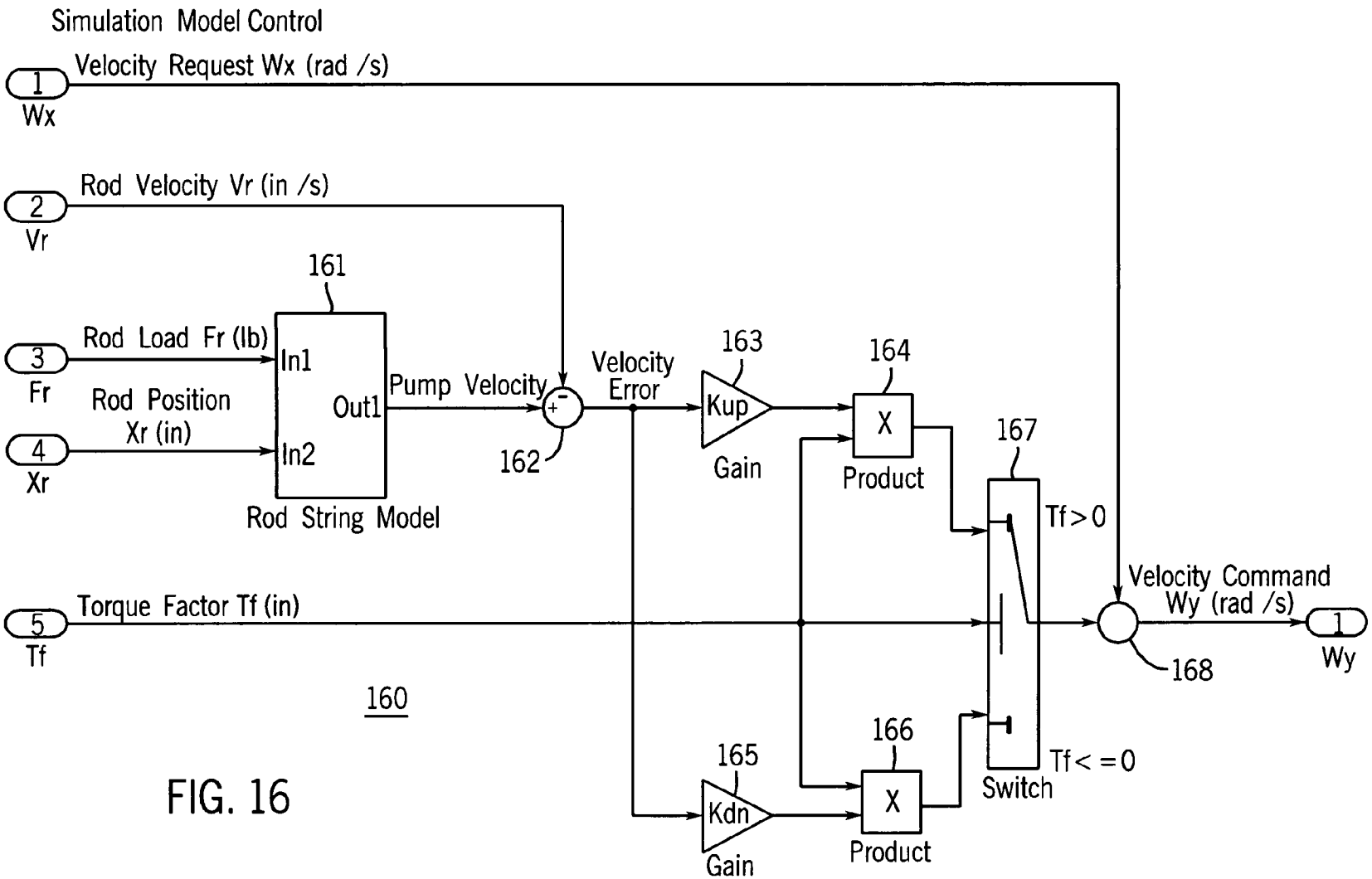
FIG. 16 is a block diagram of a multisection simulation model based rod pump control in accordance with the present invention.

Referring to FIG. 16, there is shown the block diagram of a system 160, wherein the rod position Xr and rod load Fr parameters, which can be from the estimator in FIG. 3, can be used along with a multisection simulation model of the rod string to provide a control function referred to hereinafter as a simulation model control.

Rod load Fr and rod position Xr are input to rod string model block 161. The rod string model simulates the rod behavior by dividing the rod string into a finite number of elements. Each element has a mass and spring constant. The dynamic effects of the changing rod load Fr and rod position Xr are calculated on each section to determine the velocity of the downhole pump.

The rod velocity Vr, which can be from the estimator in FIG. 3, is subtracted from the pump velocity in summing block 162 to determine the velocity error term. If the torque factor Tf, which can be from the estimator in FIG. 3, is greater than zero, switch block 167 causes the velocity error to be multiplied by the gain factor Kup in gain block 163 and then multiplied by the torque factor Tf in multiplier block 164. If the torque factor Tf is less than or equal to zero, switch block 167 causes the velocity error to be multiplied by the gain factor Kdn in gain block 165 and then multiplied by the torque factor Tf in multiplier block 166. The result is then added to the velocity request Wx by summing block 168 to generate the velocity command Wy.

Figure 17:
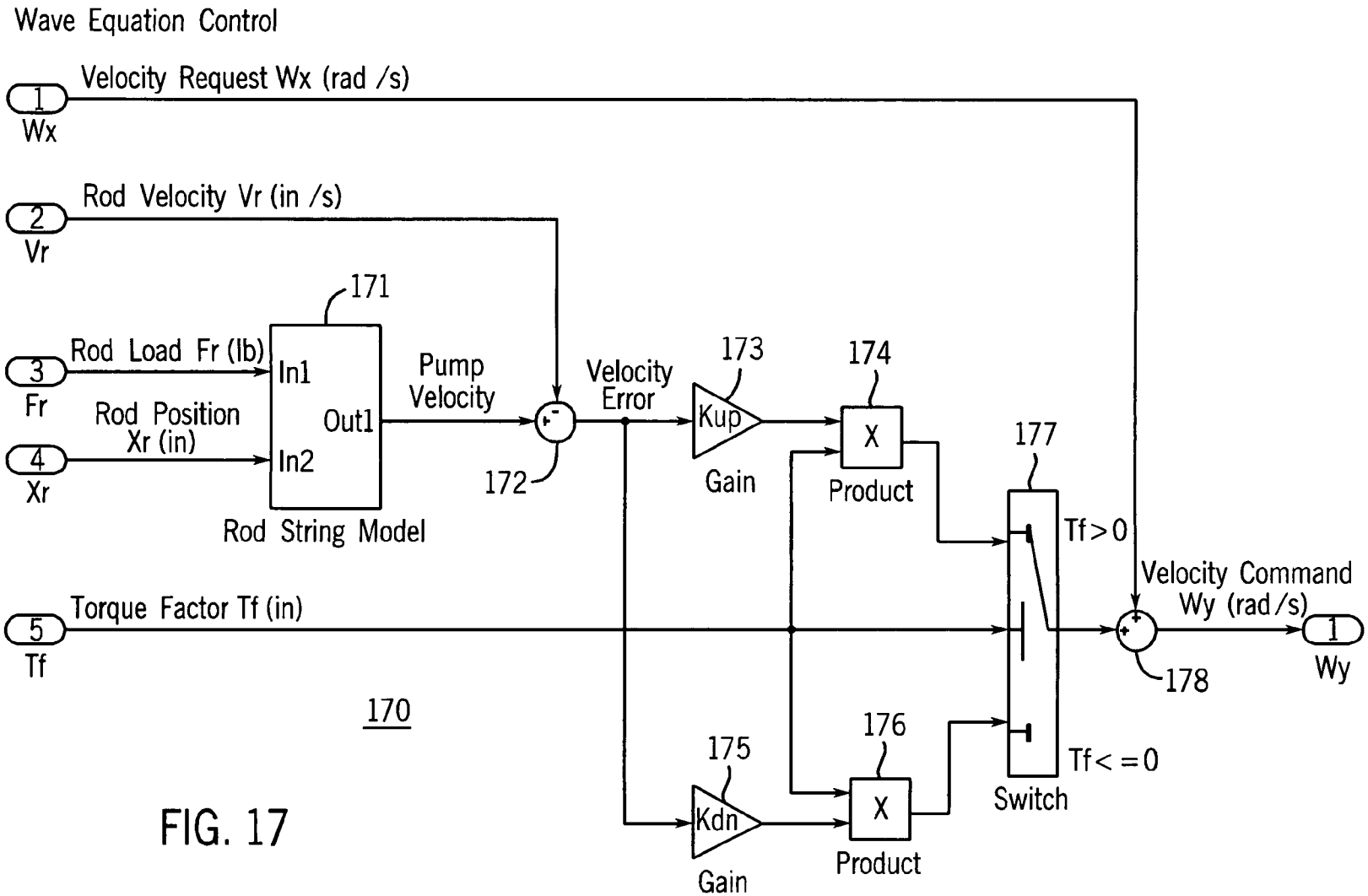
FIG. 17 is a block diagram of a wave equation based rod pump control in accordance with the present invention.

Referring to FIG. 17, there is shown the block diagram of a system 170, wherein the rod position Xr and rod load Fr parameters, which can be from the estimator in FIG. 3, can be used along with a wave equation model of the rod string to provide a control function referred to hereinafter as a wave equation control.

The wave equation control is a control algorithm capable of damping rod load oscillations, reducing rod stress, and increasing pump stroke without changing the overall pumping speed, or in the alternative, maintaining the well output with decreased overall pumping speed. The wave equation control according to the invention increases the pump stroke, decreases peaks in rod load and dampens rod load oscillations. However, average pumping speed is not affected. The wave equation control enables increased output in wells that are running at maximum conventional capability of the pumping system.

The wave equation control manipulates motor velocity to maximize downhole pump stroke. The control function provided by the wave equation control basically consists of estimating pump velocity state by means of a discrete rod string, fluid, and pump model. The pump velocity state is then multiplied by a damping gain and summed with the request velocity. This lowers the rod load overshoot through active damping while also increasing the downhole pump stroke. This results in an increase in output flow rate without an increase in overall average pumping speed which, in turn, increases well output without increasing overall pumping speed. This can provide increased output in wells that are running at maximum capacity. Alternatively, a given well output can be maintained with decreased overall pumping speed.

More specifically, with reference to FIG. 17, the wave equation control includes a rod string model 171 in which the rod load Fr and rod position Xr can be from the parameter estimator of FIG. 3.

The wave equation control 170 employs a rod string model (i.e., rod string model 171) that produces pump velocity Vp and pump position Xp states. However in one embodiment, only the pump velocity Vp is used in the control function. Although pump position Xp is not used for control, pump position can be used to estimate pump stroke Sp. The pump stroke information, in turn, can be used to generate flow rate information.

The rod/pump simulation 171 responds to rod position Xr and rod load Fr and produces an output representative of simulated pump velocity Vp.

The rod velocity Vr, which can be from the estimator in FIG. 3, is subtracted from the pump velocity in summing block 172 to determine the velocity error term. If the torque factor Tf, which can be from the estimator in FIG. 3, is greater than zero, switch block 177 causes the velocity error to be multiplied by the gain factor Kup in gain block 173 and then multiplied by the torque factor Tf in multiplier block 174. If the torque factor Tf is less than or equal to zero, switch block 177 causes the velocity error to be multiplied by the gain factor Kdn in gain block 175 and then multiplied by the torque factor Tf in multiplier block 176. The result is then added to the velocity request Wx by summing block 178 to generate the velocity command Wy.

Figure 18:
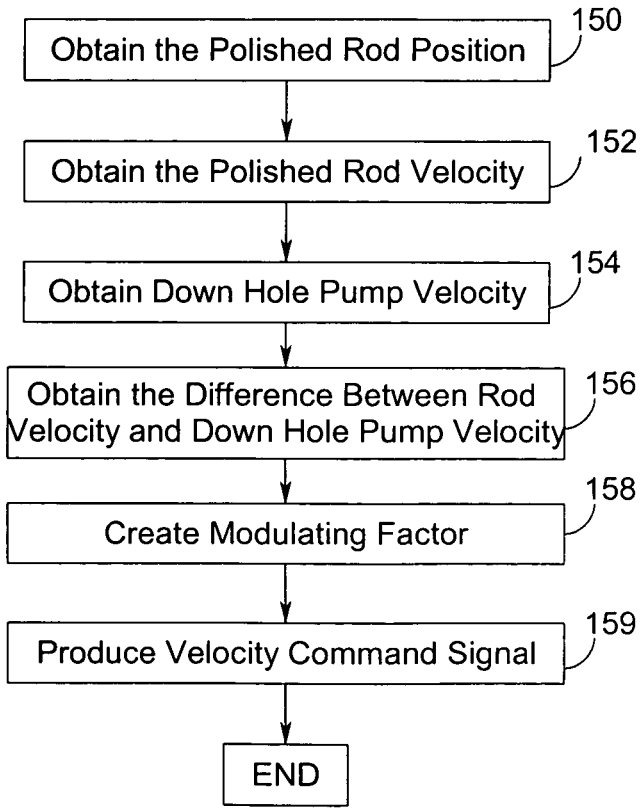
FIG. 18 is a process flow chart for producing rod pump control for improved operation of the rod pump system of FIG. 1.

Referring to FIG. 18, there is shown a process flow diagram for producing simulation model control and wave equation control in accordance with the invention. Block 150 obtains the polished rod position Xr. This can be done using the algorithm as described above with reference to FIG. 3.

Block 152 obtains the polished rod velocity Vr. This can be done using the algorithm as described above with reference to FIG. 3.

The downhole pump velocity Vp is obtained in block 154. This is obtained using the rod string model 161 for the simulation model control or 171 for the wave equation control.

Then, the difference of the surface rod velocity Vr and the downhole pump velocity Vp is obtained in block 156 by subtracting the pump velocity from the polished rod velocity, as shown by summing blocks 162 and 172.

The modulating factor is created in block 158 by applying the damping difference between the surface rod velocity and the pump velocity to the proportional gain amplifiers selected from 163, 165, 173 and 175 by switch blocks 167 and 177 and then multiplying by the torque factor Tf in blocks 164, 166, 174 and 176.

The modulating factor is combined with the velocity request Wx by summing blocks 168 and 178 to produce a command velocity Wy for the drive motor 32. The velocity command Wy signal varies as a function of the change in rod velocity Vr relative to pump velocity Vp.

Figure 19:
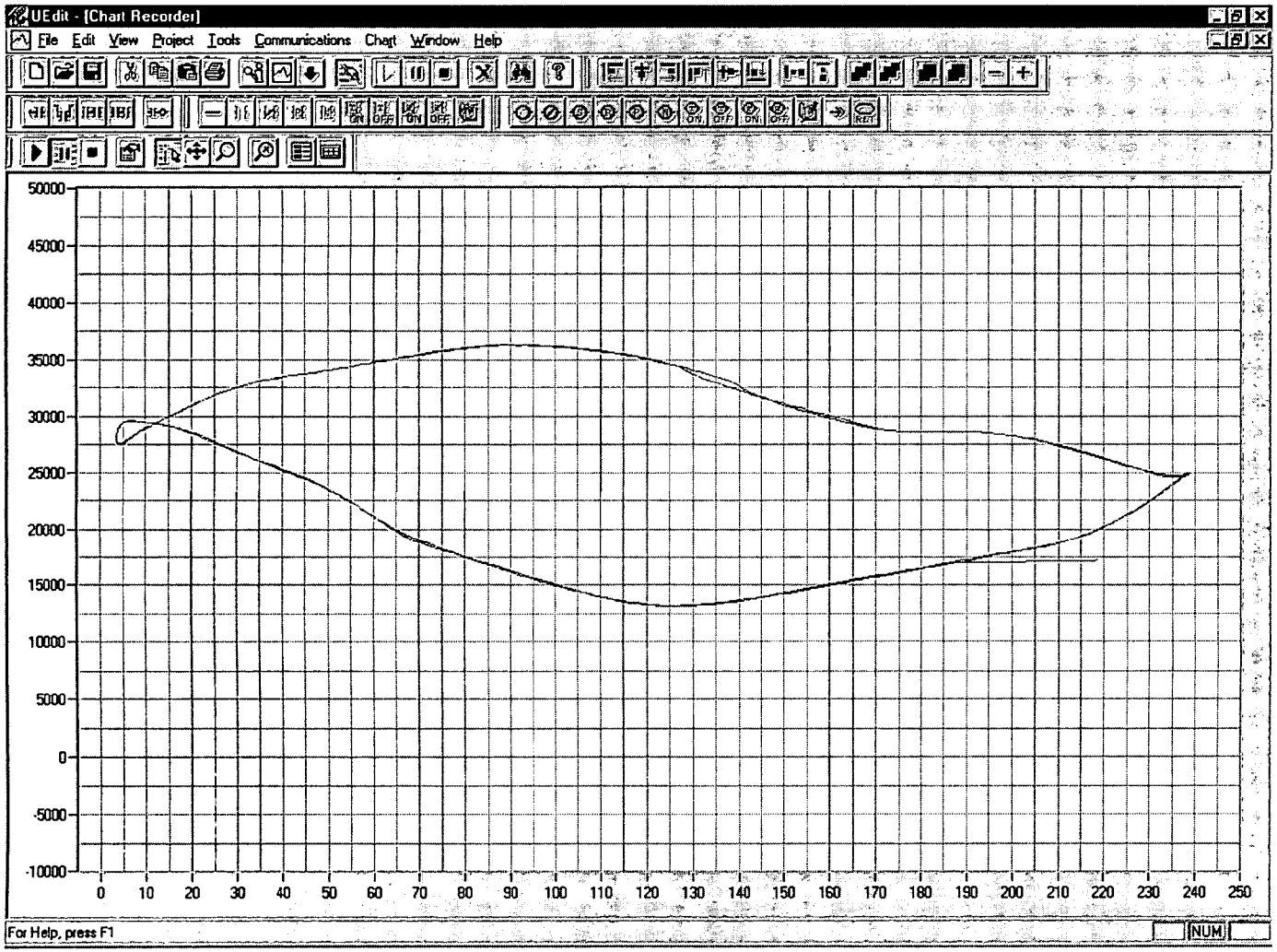
FIG. 19 is a surface dynamometer card for a beam pump running without rod pump control.
Figure 20:
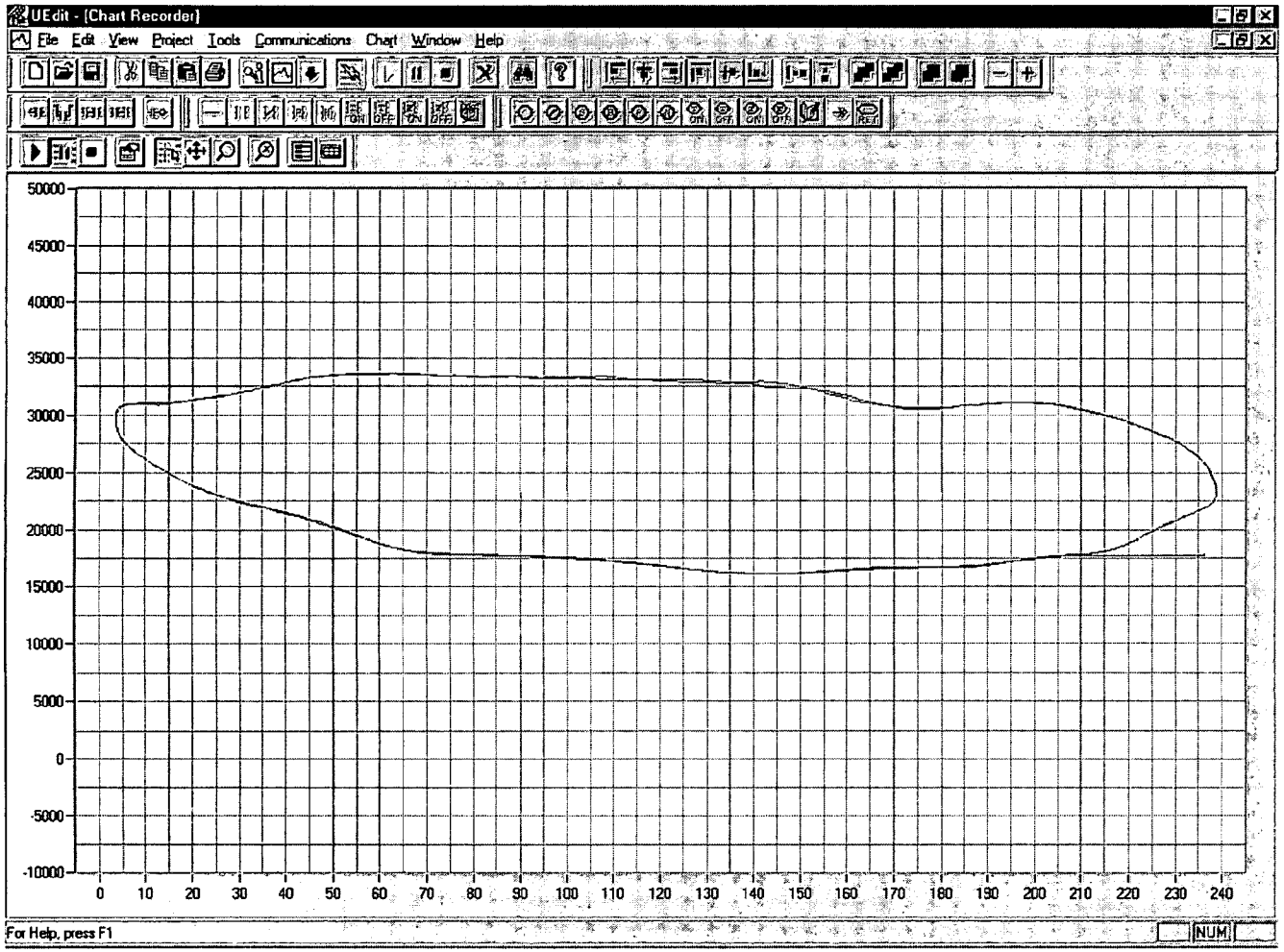
FIG. 20 is a surface dynamometer card for a beam pump running with rod pump control.

FIGS. 19-24 illustrate results of a beam pump running with and without the simulation model control algorithm enabled. Referring initially to FIGS. 19 and 20, there is shown a surface dynamometer card for a pump running without simulation model control and with simulation model control, respectively. The data is that for a beam pump running at seven strokes per minute.

As can be seen by comparing the dynamometer card in FIG. 19 with the dynamometer card shown in FIG. 20, with the simulation model control enabled, the rod stress fluctuation is reduced by lowering the peak rod up stroke load while the raising minimum rod down stroke load. For example, the dynamometer card in FIG. 19 shows a peak rod load of about 36,000 pounds while the dynamometer card in FIG. 20 shows a peak rod load of about 33,000 pounds. In addition, the dynamometer card in FIG. 19 shows a minimum rod load of about 13,000 pounds while the dynamometer card in FIG. 20 shows a minimum rod load of about 16,000 pounds. Rod load oscillation is dampened as can be seen by comparing FIG. 19 with FIG. 20. Rod load fluctuation of 17,000 (33,000–16,000) pounds with rod pump control is 26% less then the 23000 (36,000–13,000) pounds without simulation model control.

Figure 21:
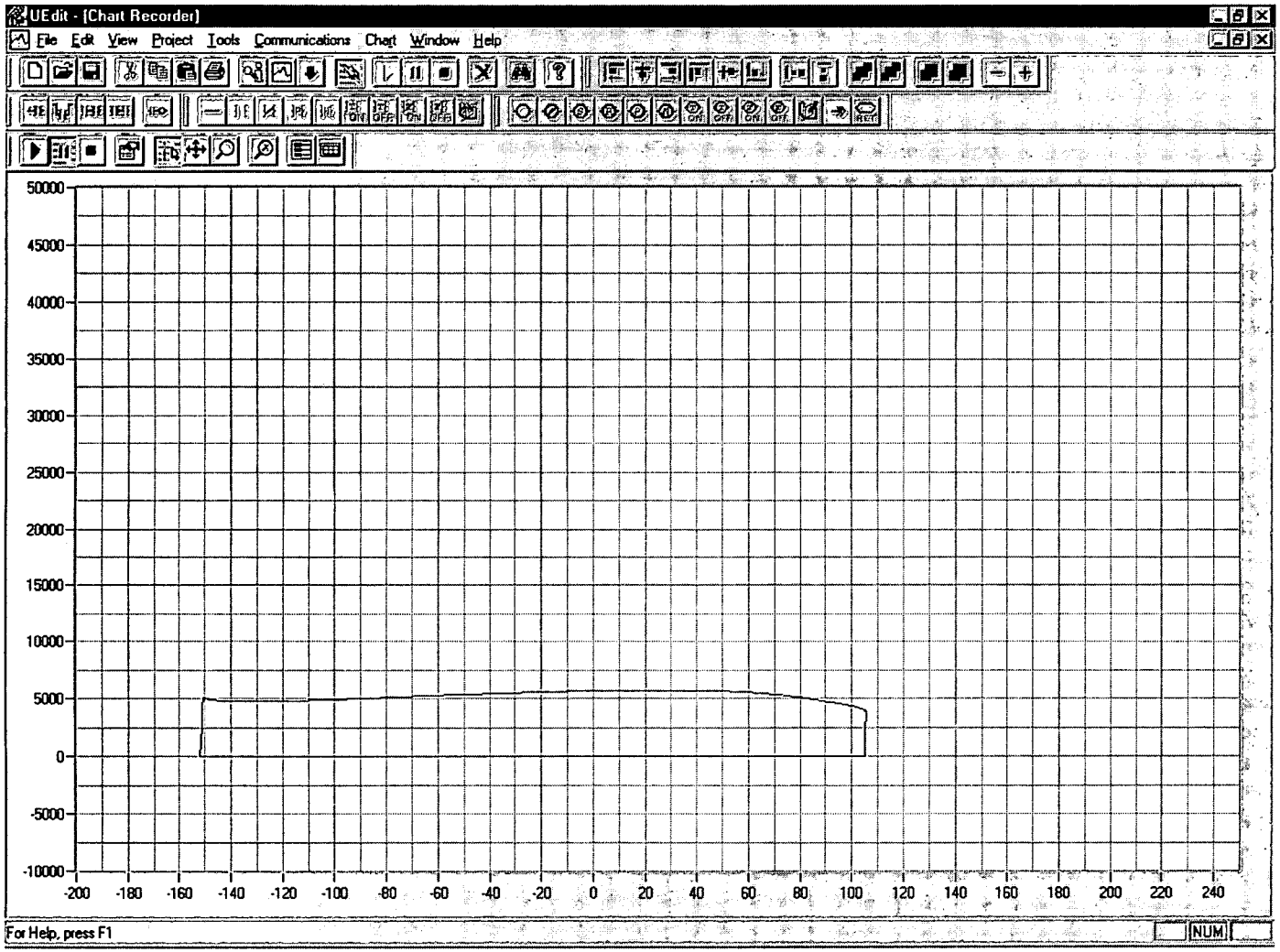
FIG. 21 is a downhole dynamometer card for a beam pump running without rod pump control.
Figure 22:
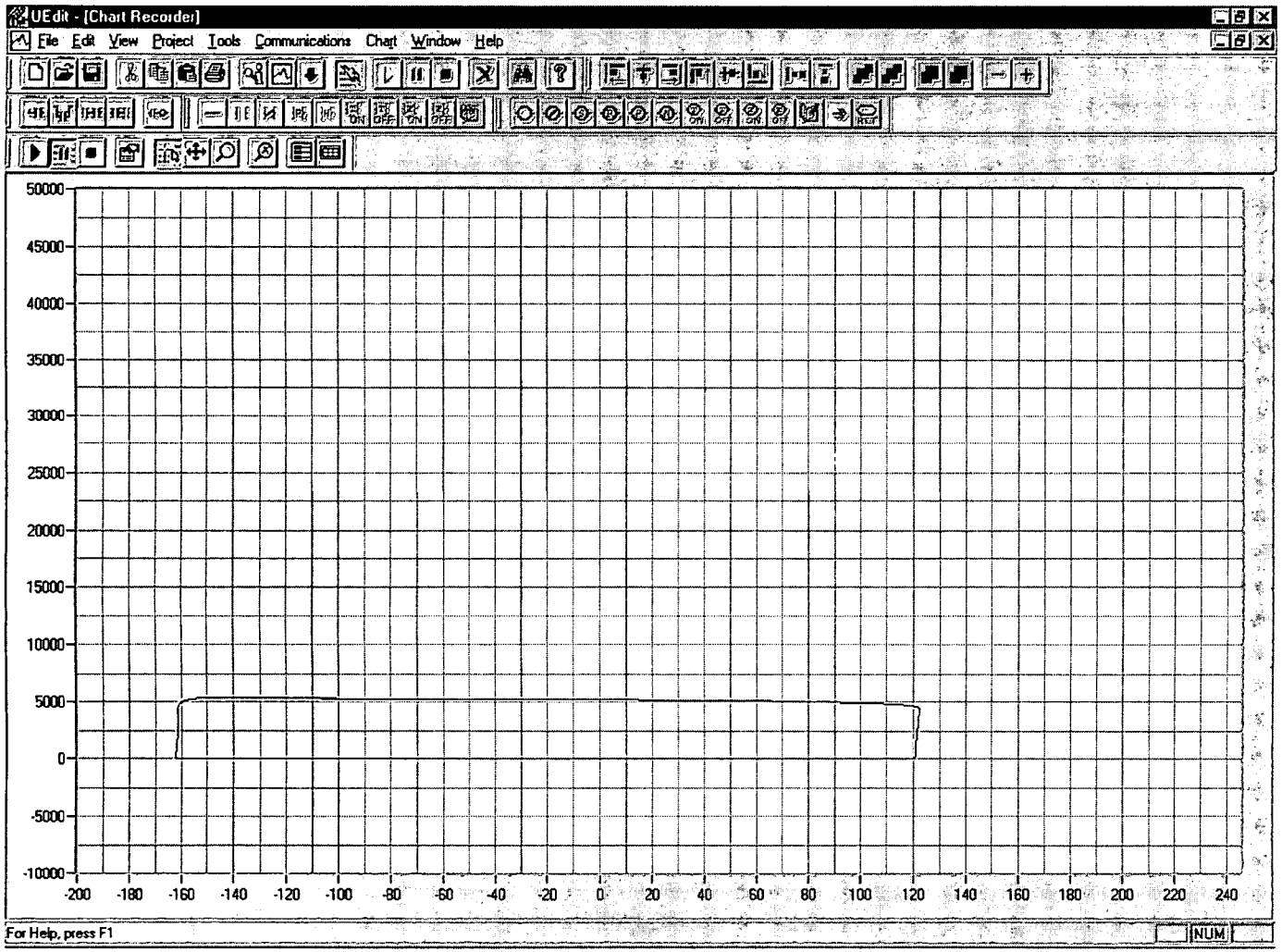
FIG. 22 is a downhole dynamometer card for a beam pump running with rod pump control.

FIGS. 21 and 22 show the downhole pump dynamometer cards associated with FIG. 19 and FIG. 20 respectively. As can be seen by comparing the dynamometer card in FIG. 21, without simulation model control, with the dynamometer card shown in FIG. 22, with the simulation model control, the pump stroke has increased from 255 inches to 282 inches. This 27 inch difference translates to an increase in fluid production of nearly 11%.

Figure 23:
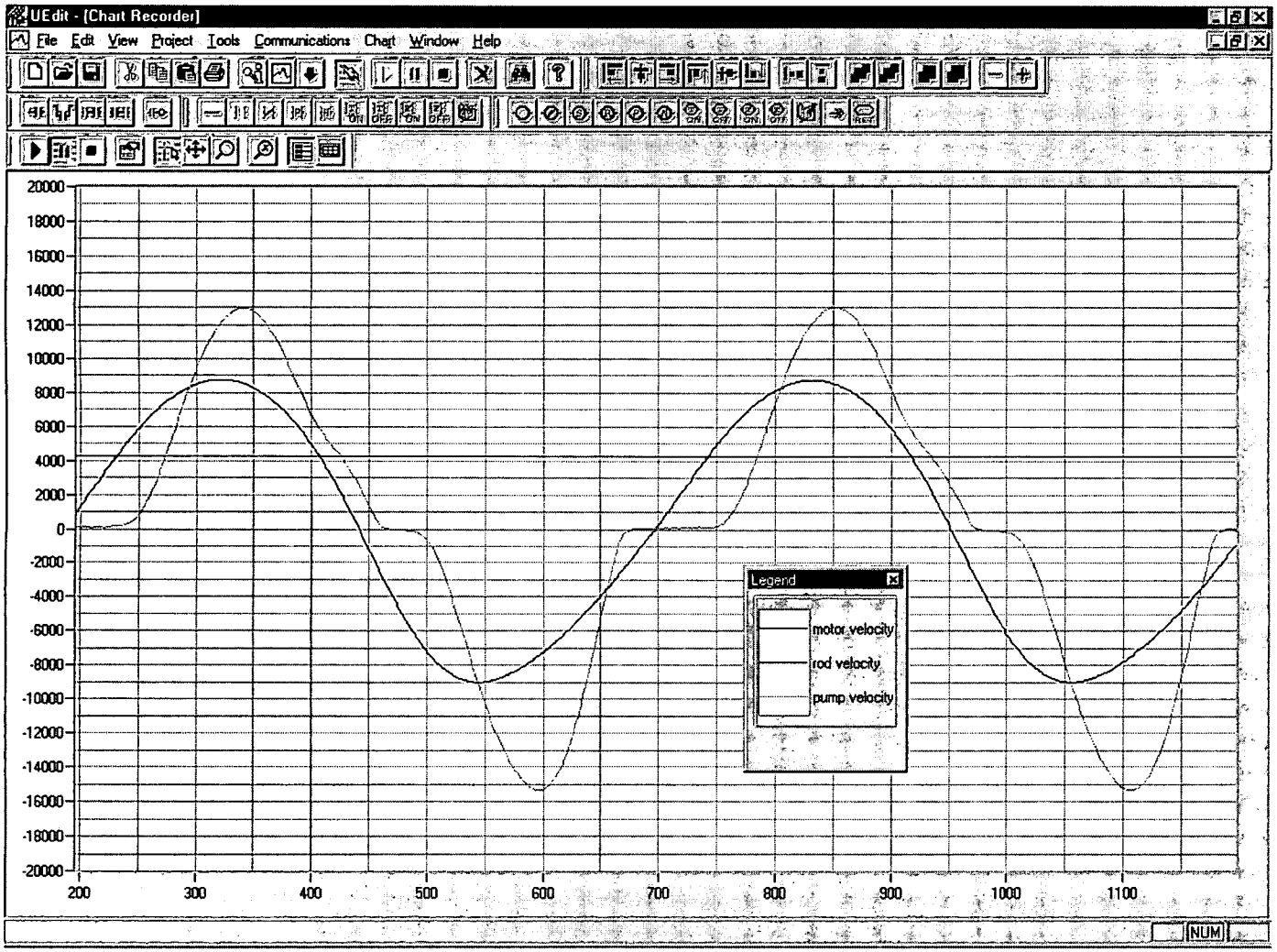
FIG. 23 is a graph showing pump velocity as a function of time for a beam pump running without rod pump control.
Figure 24:
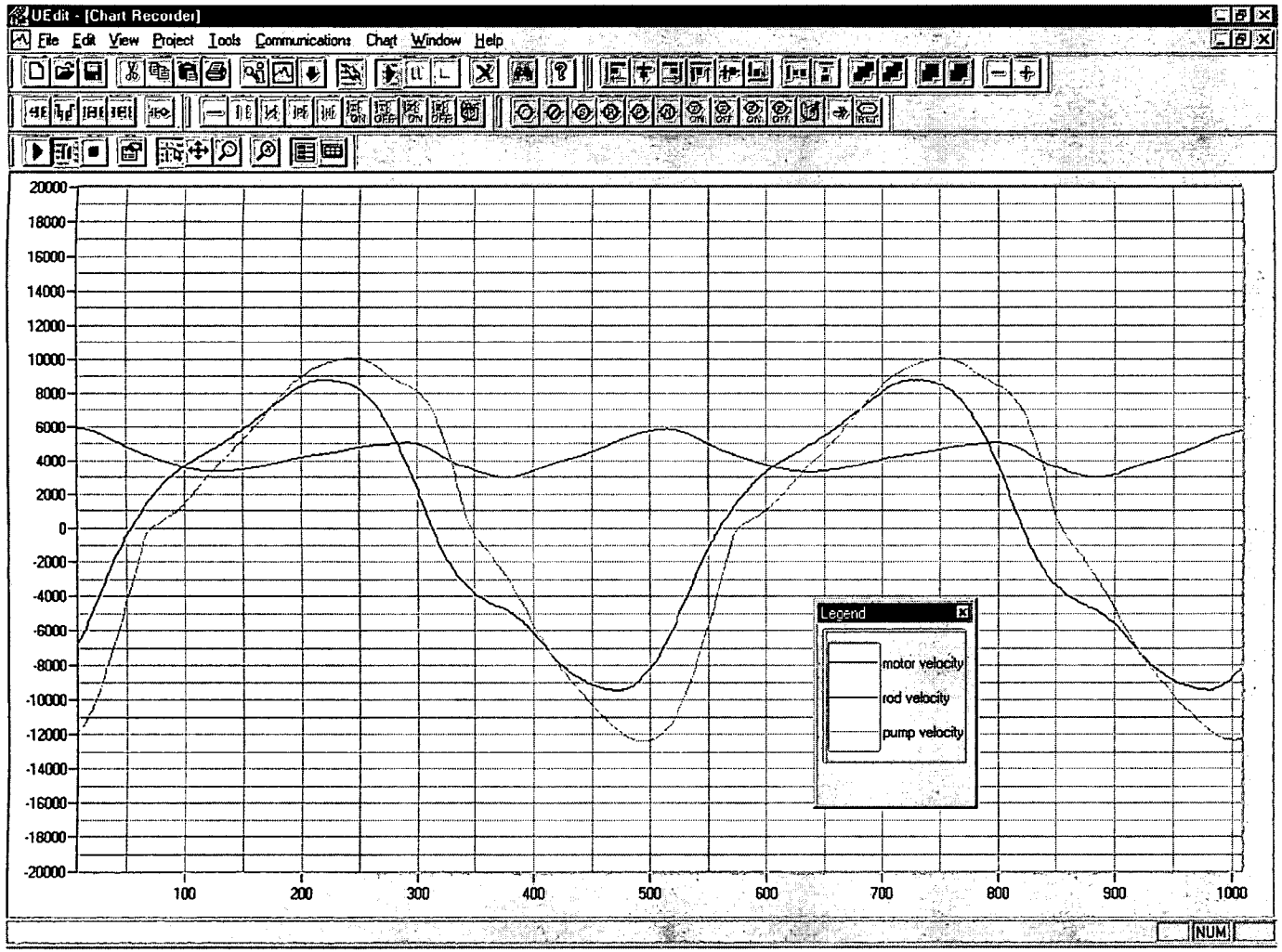
FIG. 24 is a graph showing pump velocity as a function of time for a beam pump running with rod pump control.

Additional advantages of simulation model control can be seen by comparing the graphs in FIGS. 23 and 24. Graphs in those figures show motor velocity Wr, pump velocity Vp, and rod velocity Vr. Without simulation model control, FIG. 23, the pump velocity reaches peak values that are nearly twice that of the polished rod and considerable time is spent dwelling at zero velocity. When simulation model control is enabled, FIG. 24, the peak pump velocity more nearly tracks polished rod velocity and no time is wasted dwelling at zero velocity. This provides for increased pump stroke without the need for high pump peak speeds.

In this example, pump stroke is increased approximately 11% with no overall change in average pumping unit speed. In addition, peak rod load is reduced, minimum rod load is increased, rod load oscillation is dampened, and peak pump velocity is reduced.

Figure 25:
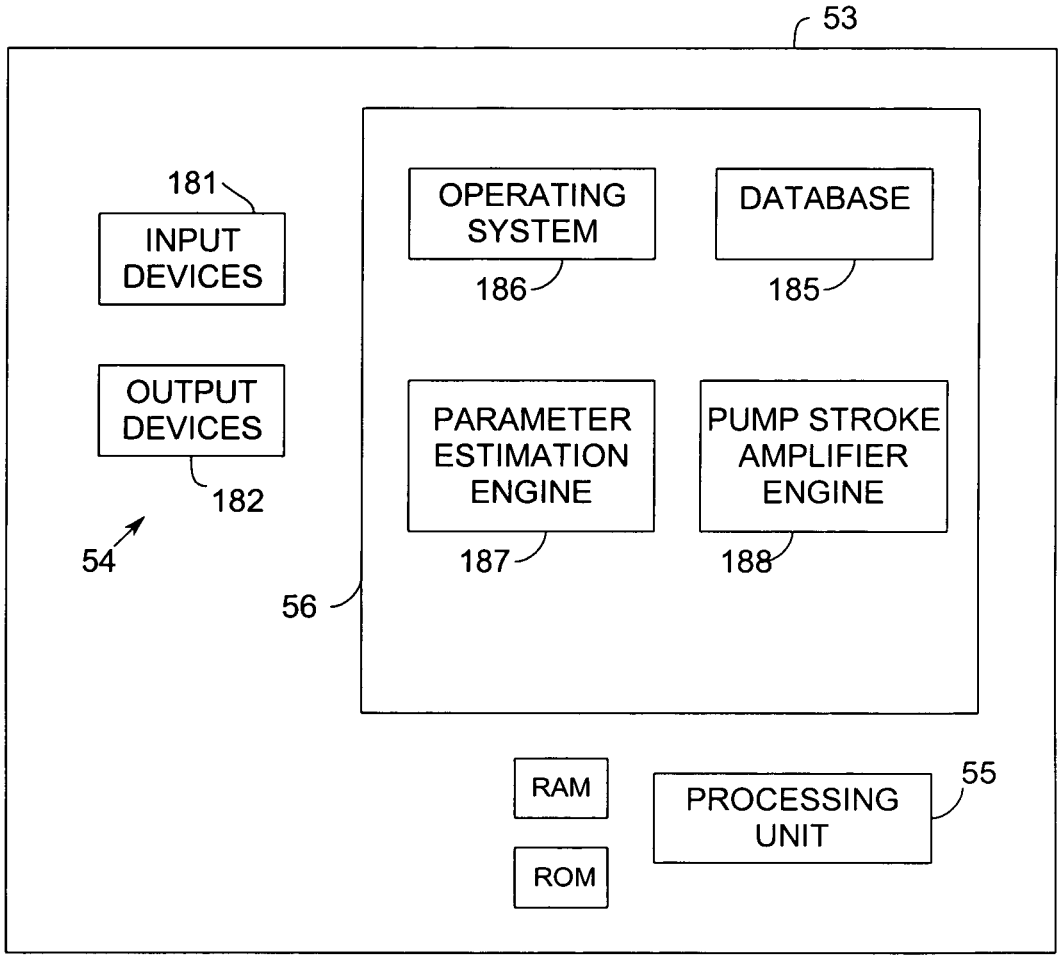
FIG. 25 is a block diagram of a processor of the rod pump control system of FIG. 2.

Referring to FIG. 25, in one preferred embodiment, the system provided by the present invention, is software based and is capable of being executed in a processor 53 shown in block diagram form in FIG. 25. In one embodiment, the computer system includes input devices 181, such as current and voltage sensors connected to analog to digital converters, output devices 182, such as, a variable frequency drive, and a processing unit 55 having associated random access memory (RAM) and read-only memory (ROM). In one embodiment, the storage devices include a database 185 and software programs and files which are used in carrying out simulations of circuits and/or systems in accordance with the invention. The programs and files of the computer system include an operating system 186, the parameter estimation engine 187, and a control method 188 such as the simulation model control engine, rod load control engine, rod load damping control engine or wave equation control engine, for example. The programs and files of the computer system can also include or provide storage for data. The processor is connected through suitable input/output interfaces and internal peripheral interfaces (not shown) to the input devices, the output devices, the storage devices, etc., as is known.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A method of continuously determining operating parameters of a rod pump used in oil or gas production, the rod pump including a rod string carrying a down hole pump and a drive system including an AC electrical drive motor having a rotor coupled to the rod string through a transmission unit, the rod string including a polished rod, said method comprising the steps of:

using voltage sensors and current sensors associated with the drive motor to continuously measure electrical voltage applied to the drive motor and electrical current drawn by the drive motor, and using the measured values of electrical voltage applied to the drive motor and electrical current drawn by the drive motor to calculate nearly instantaneous torque and nearly instantaneous velocity inputs to the rode pump without external instrumentation, wherein the external instrumentation includes rod load sensor, rod position sensor, down hole sensor, echo meter or flow sensor; and using parameters related to the geometry of the rod pump and said torque and velocity values to calculate values in real-time, of polished rod load, and wherein calculating said values of polished rod load includes the steps of deriving a crank angle value from the motor velocity values, using the crank angle value and the values of electrical torque in calculating values of polished rod load, and including using parameters representing the geometry of the rod pump together with the crank angle value to calculate a torque factor, and including using an overall gear ratio of the transmission unit to calculate from the electrical torque value, the output torque of the transmission unit, and further including the steps of:

using parameters representing the geometry of the rod pump and the motor velocity values to derive a value of rotary weight torque for the crankshaft;

using parameters representing the geometry of the rod pump and a torque factor derived from the parameters representing the geometry of the rod pump and the crank angle to obtain a value of load inertia for the drive motor;

deriving from the motor velocity values, values of instantaneous acceleration of the rotor of the drive motor;

and using the rotary weight torque value, the load inertia value, the motor acceleration values, the torque factor, the electrical torque value and at least one characteristic value of the rod pump to calculate instantaneous load for the polished rod, wherein all the calculations and derivations are performed by a processing unit.

2. The method according to claim 1, further comprising the step of calculating values of polished rod position, and wherein calculating said polished rod position values includes the steps of deriving a crank angle value from the motor velocity values, and using the crank angle value in calculating values of the position of the polished rod.

3. The method according to claim 2, wherein deriving the crank angle value includes integrating with respect to time, the motor velocity values to get a value indicative of a position which, when combined with the overall gear ratio of a gearbox of the transmission unit and a reference position produces a value corresponding to the angular position of an output crankshaft of the transmission unit.

4. The method according to claim 1, wherein calculating the rotary weight torque includes the steps of combining the crank angle value and a counterweight angle to produce an angular position value; and multiplying the angular position value by a factor related to rotary weight.

5. The method according to claim 1, wherein calculating the load inertia value includes the steps of combining the torque factor and a value corresponding to the weight of the beam weight at the polished rod to produce an inertia value, combining the inertia value with a value indicative of the inertia of a counterweight of the rod pump, and combining the result with a value corresponding to the inertia of the rotor of the drive motor.

6. The method according to claim 1, wherein deriving the acceleration value includes differentiating the motor velocity value with respect to time.

7. The method according to claim 1, wherein obtaining the electrical torque values includes obtaining an estimate of a value of stator flux, and using the stator flux estimate value and the electrical current output signal to obtain the electrical torque value.

8. The method according to claim 1, wherein obtaining the motor velocity values includes obtaining an estimate of electrical frequency, obtaining an estimate of slip frequency, and using the estimated values of electrical frequency and slip frequency and the electrical current output signal to obtain the motor velocity value.

9. The method according to claim 1, further including using calculated values of position and load for the polished rod on a real-time, close-loop control basis to obtain a surface dynamometer card for the rod pump, and deriving from the surface dynamometer card a down hole dynamometer card for the rod pump.

10. The method according to claim 9, wherein deriving the down hole dynamometer card includes using a wave equation to model the force trajectory along the rod string in distance and time, and wherein boundary conditions for the wave equation include polished rod load and displacement as a function of time.

* * * * *